US008042553B2

(12) United States Patent
Paris

(10) Patent No.: US 8,042,553 B2
(45) Date of Patent: Oct. 25, 2011

(54) MEDICAL HAIR PROSTHESIS SYSTEM

(76) Inventor: Joseph Paris, New York, NY (US)

( * ) Notice: Subject to any disclaimer, the term of this patent is extended or adjusted under 35 U.S.C. 154(b) by 27 days.

(21) Appl. No.: 12/367,321

(22) Filed: Feb. 6, 2009

(65) Prior Publication Data

US 2009/0199861 A1 Aug. 13, 2009

Related U.S. Application Data

(60) Provisional application No. 61/094,790, filed on Sep. 5, 2008, provisional application No. 61/026,837, filed on Feb. 7, 2008.

(51) Int. Cl.
*A41G 3/00* (2006.01)
*A41G 5/00* (2006.01)

(52) U.S. Cl. ..... 132/201; 132/54

(58) Field of Classification Search ..... 132/201, 132/274, 54, 53, 56, 213, 55, 207, 200; 446/394; 623/15.11; 62/62, 64
See application file for complete search history.

(56) References Cited

U.S. PATENT DOCUMENTS 670,857 A * 3/1901 Dorenwend ..... 132/54
3,645,276 A * 2/1972 Chaihyung ..... 132/201
4,509,539 A * 4/1985 Alfieri ..... 132/53
4,619,280 A * 10/1986 Yampolskaya ..... 132/214
5,406,971 A * 4/1995 Taylor ..... 132/201
5,657,774 A * 8/1997 Niese ..... 132/54
5,746,232 A * 5/1998 Martin et al. ..... 132/54
5,988,177 A * 11/1999 Bate ..... 132/54
6,016,814 A * 1/2000 Elliott ..... 132/201
6,352,079 B1 * 3/2002 Bate ..... 132/54
6,561,197 B2 * 5/2003 Harrison ..... 132/201
6,679,067 B1 * 1/2004 Pate et al. ..... 62/62
6,691,714 B1 * 2/2004 Yaguchi et al. ..... 132/201
7,033,581 B2 * 4/2006 Pyles ..... 424/70.1
7,735,495 B2 * 6/2010 Lane et al. ..... 132/53
2006/0081267 A1 * 4/2006 Kuptiz ..... 132/53
2006/0260627 A1 * 11/2006 Park ..... 132/54
2007/0251536 A1 * 11/2007 Kupitz ..... 132/53
2009/0188512 A1 * 7/2009 Eaton ..... 132/54
2009/0266373 A1 * 10/2009 Kupitz ..... 132/54

* cited by examiner

*Primary Examiner* — Todd Manahan
*Assistant Examiner* — Vanitha Elgart
(74) *Attorney, Agent, or Firm* — Ohlandt, Greeley, Ruggiero & Perle, L.L.P.

(57) ABSTRACT

A medical hair prosthesis for use by a wearer that has had a pronounced loss of hair, where the foundation of the medical hair prosthesis is made of lace that has gone through a cryogenic treatment process to increase durability and comfort. The medical hair prosthesis is formed by a process of harvesting the wearer's own hair to incorporate into the front hairline of the hair prosthesis.

31 Claims, 27 Drawing Sheets

MEDICAL HAIR PROSTHESIS SYSTEM

CROSS REFERENCE TO RELATED APPLICATIONS

This application claims the benefit of U.S. Provisional Application No. 61/026,837 filed on Feb. 7, 2008 and U.S. Provisional Application No. 61/094,790 filed on Sep. 5, 2008

BACKGROUND OF THE INVENTION

1. Field of the Invention

The present disclosure relates to a hair prosthesis. More particularly, the present disclosure relates to a hair prosthesis for those who suffer from medically related, rapid hair loss.

2. Description of Related Art

Traditionally, wigs and hairpieces were developed for customers purchasing for vanity or fashion reasons. Ready-made or mail order wigs are the most common, and generally come in different sizes to fit a range of wearer head sizes. These wigs are typically composed of a pre-made base and adjustable bands to provide a close fit about the entire head of the wearer. These ready-made wigs often lack comfort, and clearly lack a natural look.

Custom-made hairpieces are made to blend the wearer's actual hair with that of the hairpiece. Such hairpieces have a base and a netting or lace material. The netting commonly involves a "lace front hair system" providing a front hairline made of netting or lace, while the base is made of denser material. The base needs the denser material to have the durability, while the delicate lace is the trim and therefore not relied upon to provide the necessary durability for the hairpiece. Thus, such hairpieces have a more natural hairline, and are made to blend into the natural hair of the user. Accordingly, the hairpiece is altered gradually in order to blend into the wearer's hairline as the wearer's hairline gradually changes.

When one has been diagnosed with cancer and is advised that chemotherapy will be needed to abate the cancer, one of the first reactions is the dramatic change in appearance, namely the rapid loss of hair that will result. It is believed that the loss of hair has an adverse effect on the mental health of the patient that, in turn, impedes the possibility of a recovery. The conventional wig, which lacks a natural look, and hairpieces, cannot address the complete loss of an entire head of hair, and therefore have not been the solution.

Thus, there is a need for a comfortable, naturally-looking hair prosthesis that addresses the quick loss of hair that occurs due to a medical condition such as cancer or alopecia.

SUMMARY OF THE INVENTION

The present disclosure provides for a hair prosthesis that is directed for use by a wearer that has had a rapid and pronounced loss of hair, yet desires a natural, undetectable look, as if the wearer did not suffer the loss of hair.

The present disclosure also provides for a hair prosthesis that has a foundation made of lace that has gone through a cryogenic treatment process to increase durability and comfort.

The present disclosure further provides for a hair prosthesis with a foundation made of lace that is selectively coated with silicone and polyurethane.

These and other advantages and benefits of the present disclosure are achieved by a hair prosthesis that provides a natural, undetectable look for a wearer that has suffered a sudden and complete loss of hair. The hair prosthesis has a foundation or base made entirely of lace. The lace foundation has been treated by a cryogenic treatment process that increases the durability and, it is believed, comfort. A standard nylon lace is selected, and the cryogenic treatment process entails: lowering the temperature of the lace to approximately −300 degrees ° F. over 3 to 4 hours, holding the temperature at −300 degrees ° F. for 2 to 3 hours, and then returning the lace to ambient temperature over 3 hours. The treated base is then selectively coated with silicone and polyurethane.

The present disclosure further provides for a process for harvesting the wearer's own hair to incorporate into the front hairline of the hair prosthesis.

The present disclosure further provides for a skullcap made of an anti-bacterial cotton material to protect the wearer's scalp from irritation.

The present disclosure further provides for a scalp guard that is alcohol based to prevent irritation or inflammation caused by adhesives.

BRIEF DESCRIPTION OF THE DRAWINGS

Other and further benefits, advantages and features of the present disclosure will be understood by reference to the following specification in conjunction with the accompanying drawings, in which like reference characters denote like elements of structure and.

DETAILED DESCRIPTION OF THE PREFERRED EMBODIMENT

Figure 1:
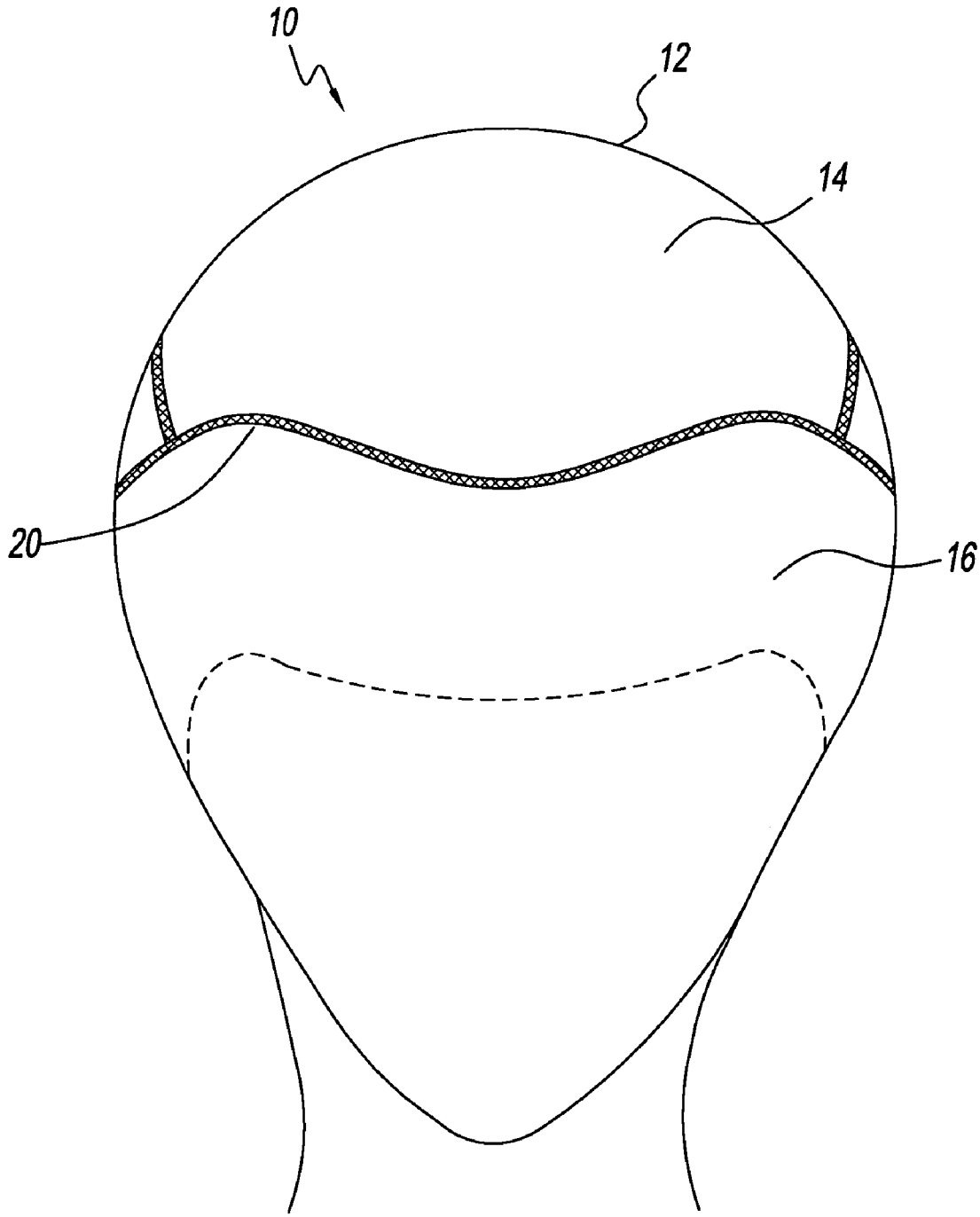
FIG. 1 illustrates a top view of a first exemplary embodiment of a hair prosthesis according to the present disclosure.
Figure 2:
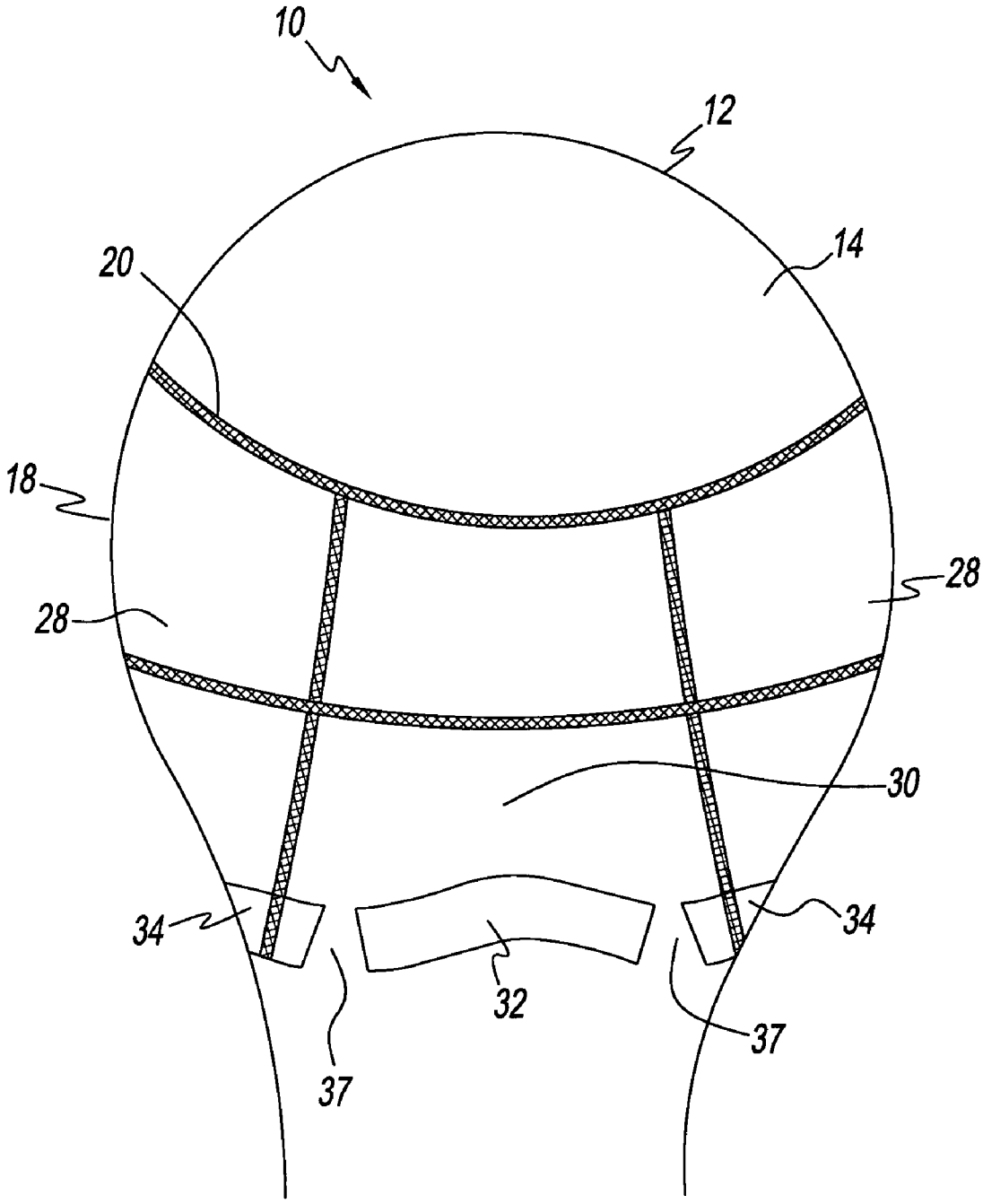
FIG. 2 illustrates a rear view of the hair prosthesis of FIG. 1.

Referring to the drawings and, in particular to FIGS. 1 and 2, a hair prosthesis according to the present disclosure is shown and generally referenced to by reference numeral 10. The hair prosthesis 10 has a base or foundation 12, which holds a plurality of human hair or synthetic fibers (not shown).

The base or foundation 12 is made completely of lace that has been treated to increase durability. This treatment is a special cryogenic treatment process that produces lace that has been found much stronger than lace material presently available, namely untreated lace. This cryogenic process entails placing ambient temperature (72° F.) standard nylon lace into a treatment chamber. The temperature in the chamber is gradually reduced to about −300° F. by cryogenic fluid, such as liquid nitrogen or another like fluid. This temperature change, known as the decent profile of the process, is accomplished gradually over a period of 3 to 4 hours to avoid cracking the lace.

Next, the lace enters the hold or static phase of the cryogenic process. The lace is held at a static temperature, about −300° F., for approximately 2 to 3 hours.

Finally, when the hold or static phase is complete, the lace in the chamber is gradually raised to return once more to ambient temperature. This temperature increase is normally achieved gradually in about 3 hours to re-introduce residual stress into the lace.

Under the direction of a Professor of Medicine and Director of Endoscopy at the Medical College of Virginia Associated Physicians, one cryogenically treated and one untreated sample of fiber were tested. The test included placing under a high power microscope one of each sample, and subjecting each sample to a torture test. The torture test namely involved incremental, increased amounts of weight being applied to each sample until a break was identified in each sample. At that point, the amount of force required to break the fiber was recorded.

The stronger sample was clearly the cryogenically treated fiber. The cryogenically treated fiber unexpectedly required four times the amount of weight in order to fracture the fiber than the untreated fiber.

Referring to FIGS. 1 and 2, the base or foundation 12 has a crown section 14, a front section 16 and a back section 18.

Crown section 14 is one continuous piece of lace that extends from the crown of the head down to the top of the occipital bone. Crown section 14 is made of lace that is 100% nylon, called HD1 lace or nylon lace. The nylon (HD1) lace is about 1 mm, and preferably 1 mm, thick. A crown seam 20 is strategically placed to ensure crown section 14 contours to the shape of the wearer's head. Crown seam 20 may be reinforced with ribbon to prevent stretching and maintain the shape of base or foundation 12. Crown seam 20 can also be removed and repositioned for customizing the fit of hair prosthesis 10.

Figure 3:
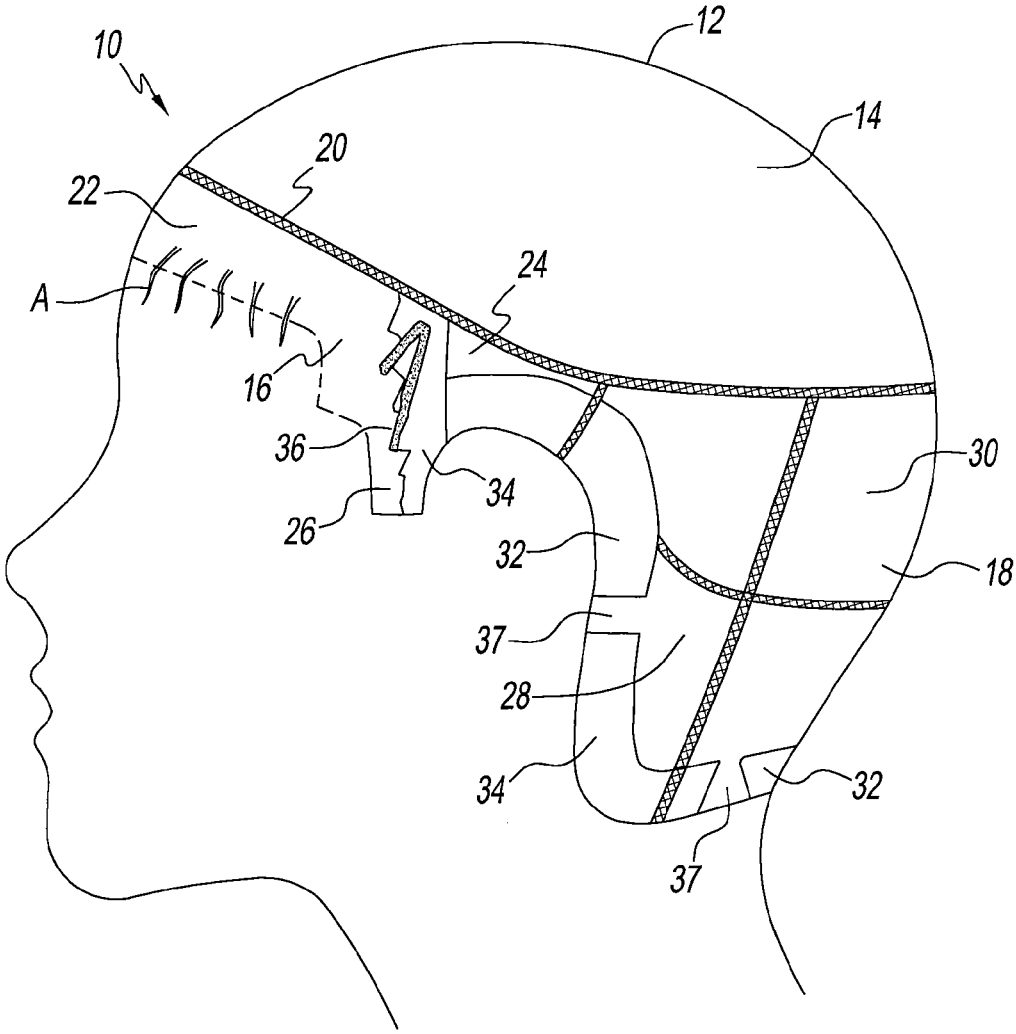
FIG. 3 illustrates a side view of the hair prosthesis of FIG. 1.

Referring to FIG. 3, front section 16 of base or foundation 12 is separated into a hairline portion 22, a pair of temple portions 24 with one on each side of hair prosthesis 10, and a pair of sideburn portions 26 one on each side of hair prosthesis 10. Hairline portion 22 is made of a lace that is a thin 100% nylon, called HD2 lace or thin lace, that is thinner than the lace used for crown section 14, but is just as strong. The thin nylon (HD2) lace is about ½ mm, and preferably ½ mm, thick. The thinner lace of hairline portion 22 provides a natural look to the front of hair prosthesis 10. Namely, the natural look includes conforming to the shape of the wearer's own hairline. Hairline portion 22 rests on a more sensitive part of the wearer's hair. Therefore, hairline portion 22 is made of the thin lace and is thus more comfortable in a part of the wearer's head in which comfort is important.

Back section 18 of base or foundation 12 is separated into two side portions 28 by a central portion 30. Each side portion 28 is located on an opposite side of base or foundation 12. Side portions 28 are made of the thin (HD2) lace that is a thin 100% nylon, and the thin lace is the same lace as that of hairline portion 22. Central portion 30 is preferably composed of lace that is about 84% nylon and about 16% spandex with the about being plus or minus 0.30%, called HD3 lace or thin stretch lace. In one exemplary embodiment, the nylon is 84.30% and the spandex is 15.70%. Significantly, this thin stretch lace (HD3) of central portion 30 allows hair prosthesis 10 to stretch, and contour to the scalp of the wearer. In another less preferred embodiment, the lace of central portion 30 may be the thin (HD2) lace, the same lace as side portions 28 and hairline portions 22.

Human hair or synthetic fibers (not shown) can be used in hair prosthesis 10. Each hair or synthetic fiber is attached to base or foundation 12 by single-strand ventilation. A knotting ventilation technique is most commonly used in lace based hair prosthesis. Thereafter, several coatings of a sealant are applied to the inside of base or foundation 12. The sealant reduces loss of the hair or fibers during cleaning of hair prosthesis 10. When human hair is used, the resulting knots may be bleached to provide the appearance that the hair is growing out of a scalp.

Referring to FIGS. 2 and 3, a silicone coating 32 is selectively applied to base or foundation 12 after the human hair or synthetic fibers are ventilated into the lace. Silicone coating 32 is applied directly onto base or foundation 12, along temple portion 24 and continuously to back section 18. Silicone coating 32 provides a smooth and comfortable touch for the wearer, yet allows for the ready receipt of adhesive, such as two-sided tape, that secures hair prosthesis 10 to the wearer's head or scalp and prevents movement of base or foundation 12. In addition, silicone coating 32 allows removal of used adhesive without damaging base or foundation 12, thereby minimizing wear and tear. Further, silicone coating 32 is applied along back section 18, namely the lower ends of side portions 28 and central portion 30, preventing hair prosthesis 10 from riding up the nape area of the scalp of the wearer. Preferably, silicone coating 32 is 1 inch wide.

FIGS. 2 and 3 also show the position of a polyurethane coating 34 on base or foundation 12. Polyurethane coating 34 is applied on temple portion 24 into sideburn portions 26, and on the lower end or back corners of side portions 28. Polyurethane coating 34 provides a smooth and comfortable touch for the wearer and another area to place an adhesive for attachment of hair prosthesis 10. Temple portion 24 also has a 1 inch wire 36 for increased support and ease in contouring hair prosthesis to the scalp. Wire 36 can be a flesh tone, laminated contour wire.

Base or foundation 12 of hair prosthesis 10 can be adjusted to fit the wearer by having pleats at specific areas called a contour adjustment or break 37 at the base or foundation 12. The position of the pleat is determined by what adjustment needs to be made to facilitate a more comfortable wear of the hair prosthesis 10 on the wearer. For example, if base or foundation 12 needs to be adjusted along hairline portion 22, then pleats are placed at temple portion 24. Behind the ear of base or foundation 12, there is a contour adjustment or break 37 in silicone coating 32. This facilitates the taking in of pleats on base or foundation 12 to adjust the fit, thereafter leaving the wearer with a smooth comfortable fit as if there were no pleats.

Figure 4:
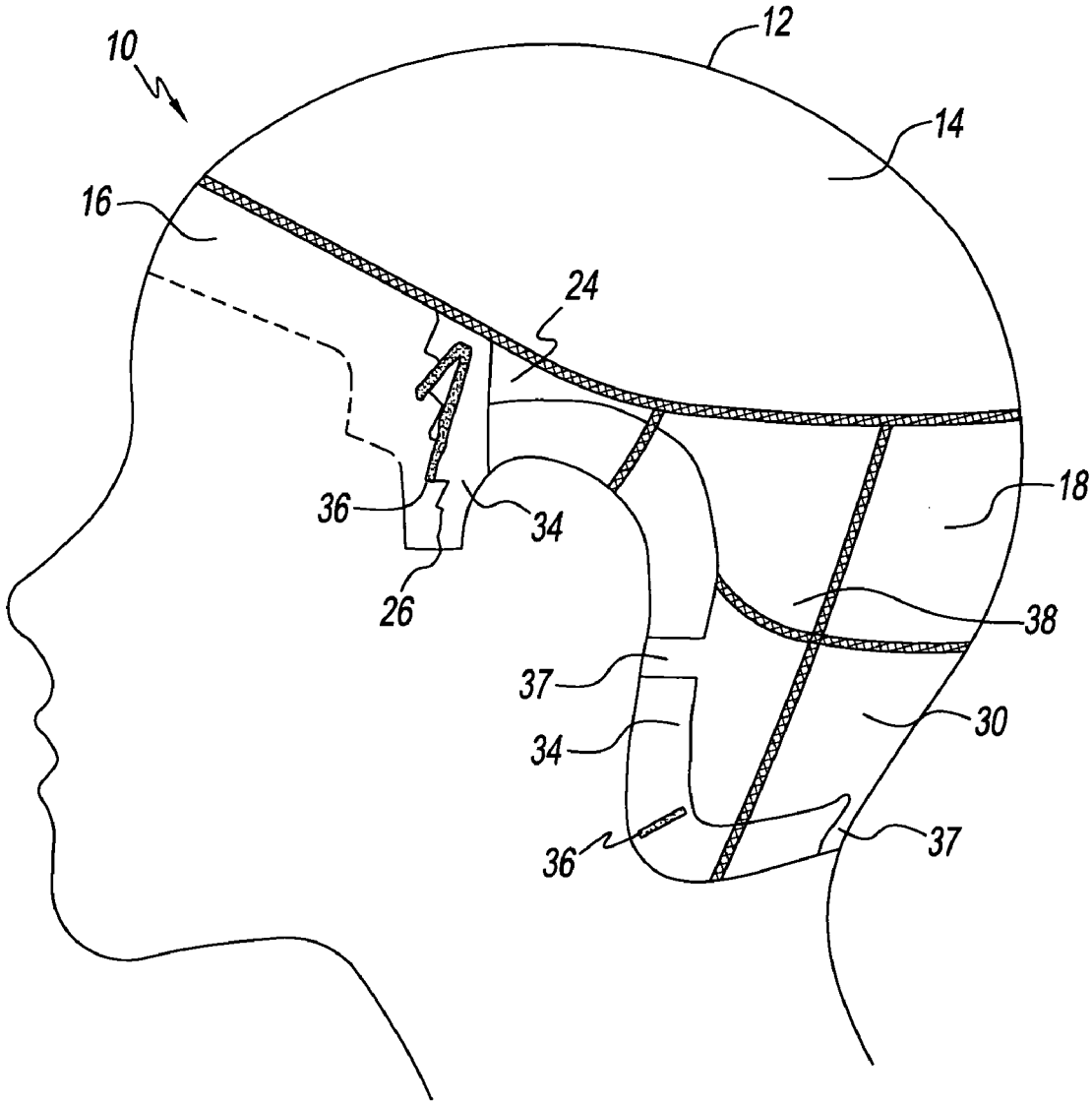
FIG. 4 illustrates a side view of a second exemplary embodiment of the hair prosthesis according to the present disclosure
Figure 5:
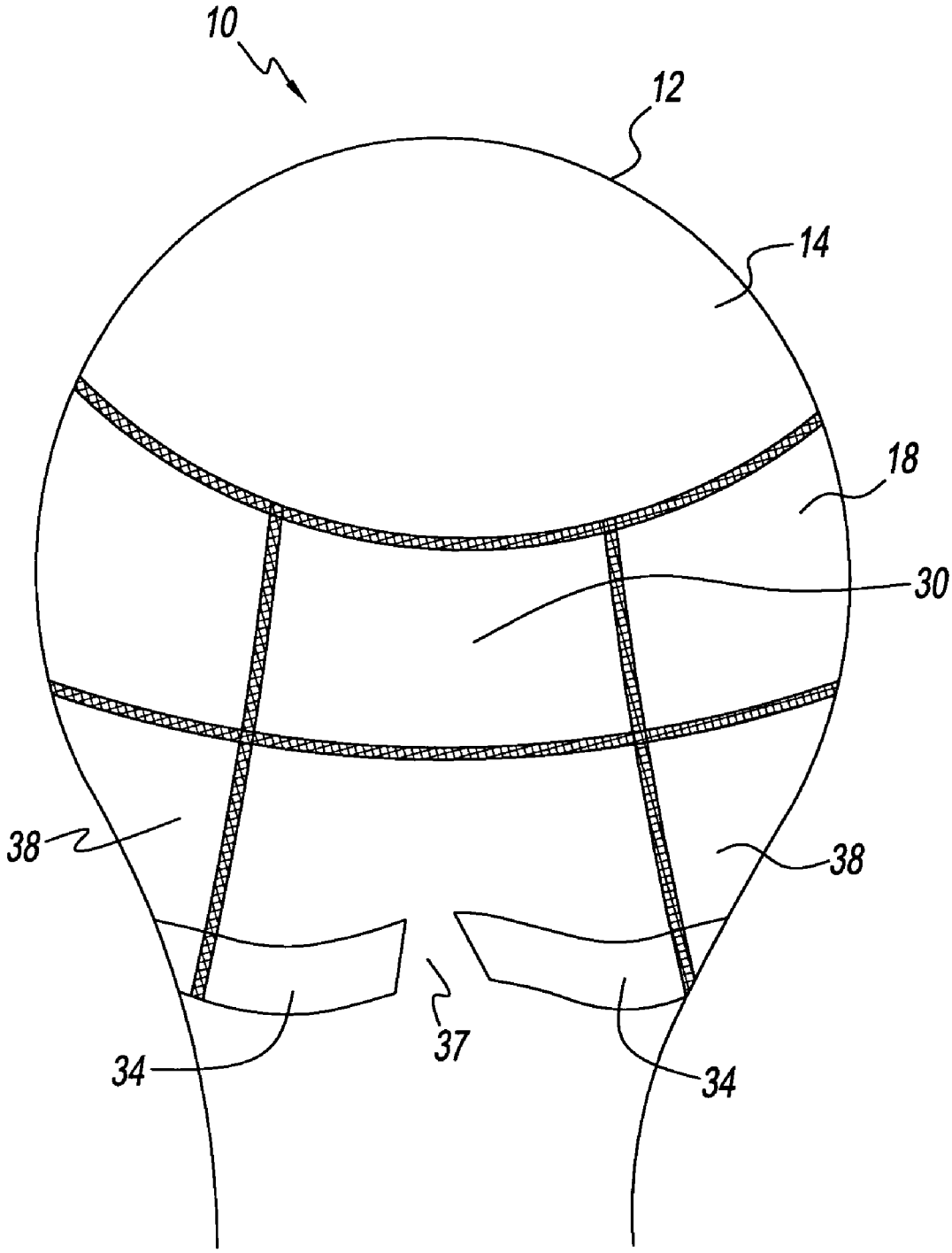
FIG. 5 illustrates a rear view of the hair prosthesis of FIG. 4.

In another embodiment, referring to FIGS. 4 and 5, crown section 14 is made of nylon (HD1) lace, front section 16 is also made of nylon (HD1) lace and back section 18 is made of either thin stretch (HD3) lace or 100% spandex. The nylon lace of crown section 14 may contain a number of holes 39 (not shown) that are about 5 mm in diameter. Holes 39 allow for multiple strand hair insertion into the lace for increased fullness for fuller hairstyles. Polyurethane coating 34 is applied on temple portion 24 into sideburn portions 26 of base or foundation 12. Further, polyurethane coating 34 is applied to the lower ends of side portions 38 and central portion 30, with breaks or contour adjustments 37. The coating applied along temple portions 24 and continuously to back section 18 is either silicone coating 32 or polyurethane coating 34, and about 2 inches wide. Wire 36 is placed at temple portions 24 and side portions 38.

Figure 6:
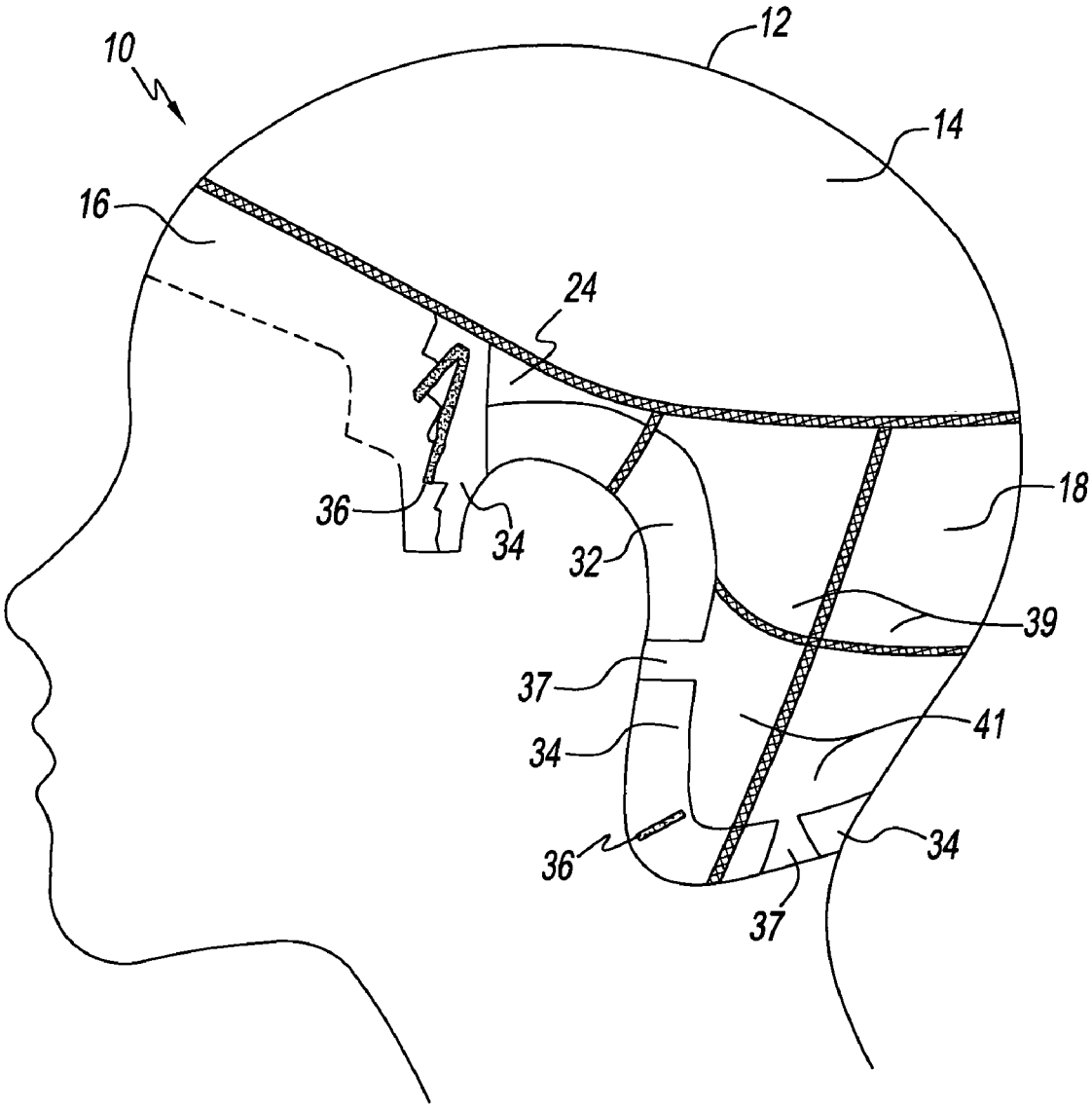
FIG. 6 illustrates a side view of a third exemplary embodiment of the hair prosthesis according to the present disclosure.
Figure 7:
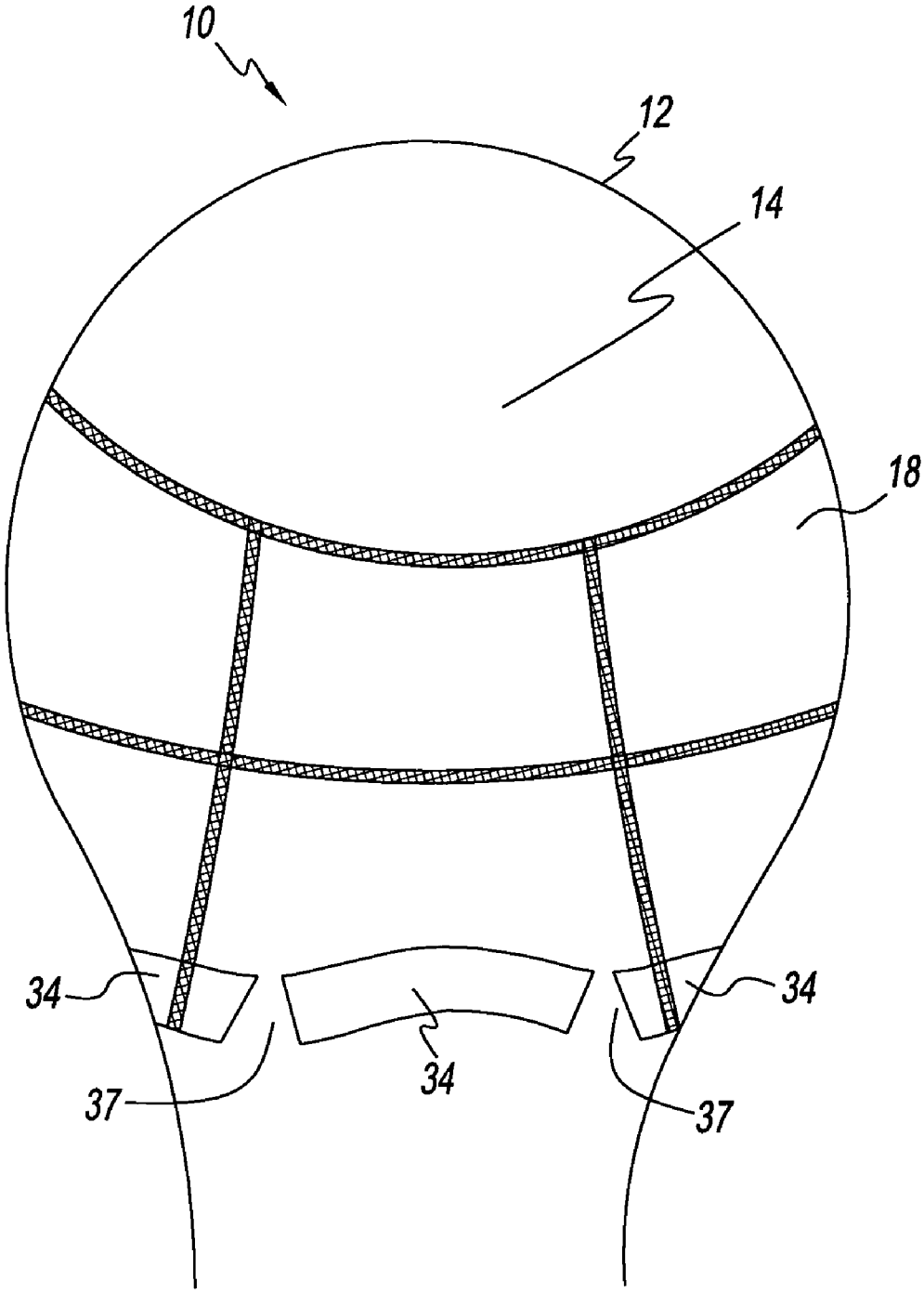
FIG. 7 illustrates a rear view of the hair prosthesis of FIG. 6.

The embodiments shown in FIGS. 6 and 7, are the same as FIGS. 4 and 5, except an upper portion of back section 39, which is directly below crown section 14, is made of thin stretch lace (HD3) lace, and a lower portion of back section 41, which is directly above the nape of the neck, is made of 100% spandex. The coating applied along the temple portions 24 and continuously to back section 18 is silicone coating 32. Also shown is an alternative placement of breaks or contour adjustments 37.

Figure 8:
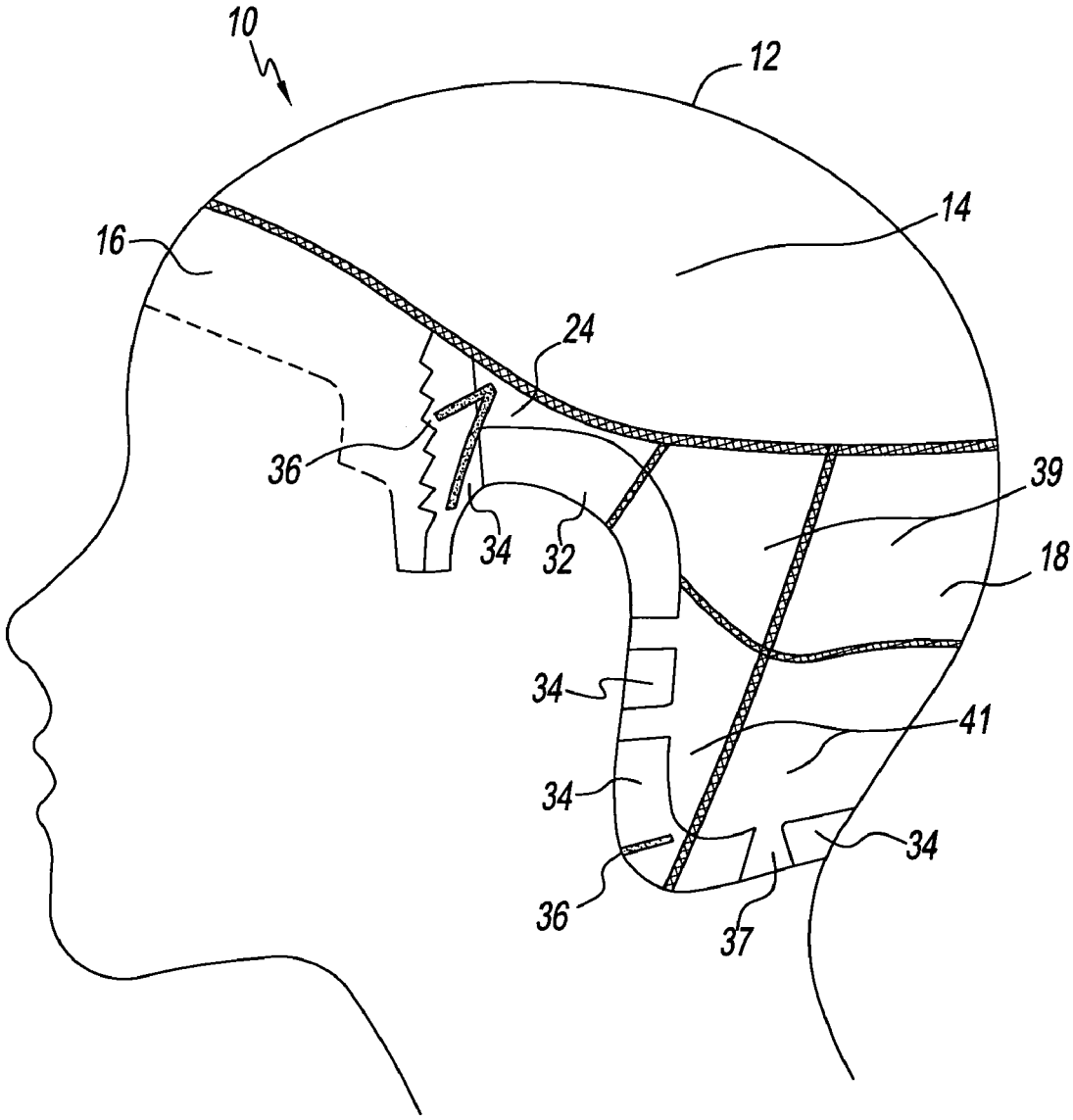
FIG. 8 illustrates a side view of a fourth exemplary embodiment of the hair prosthesis according to the present disclosure.
Figure 9:
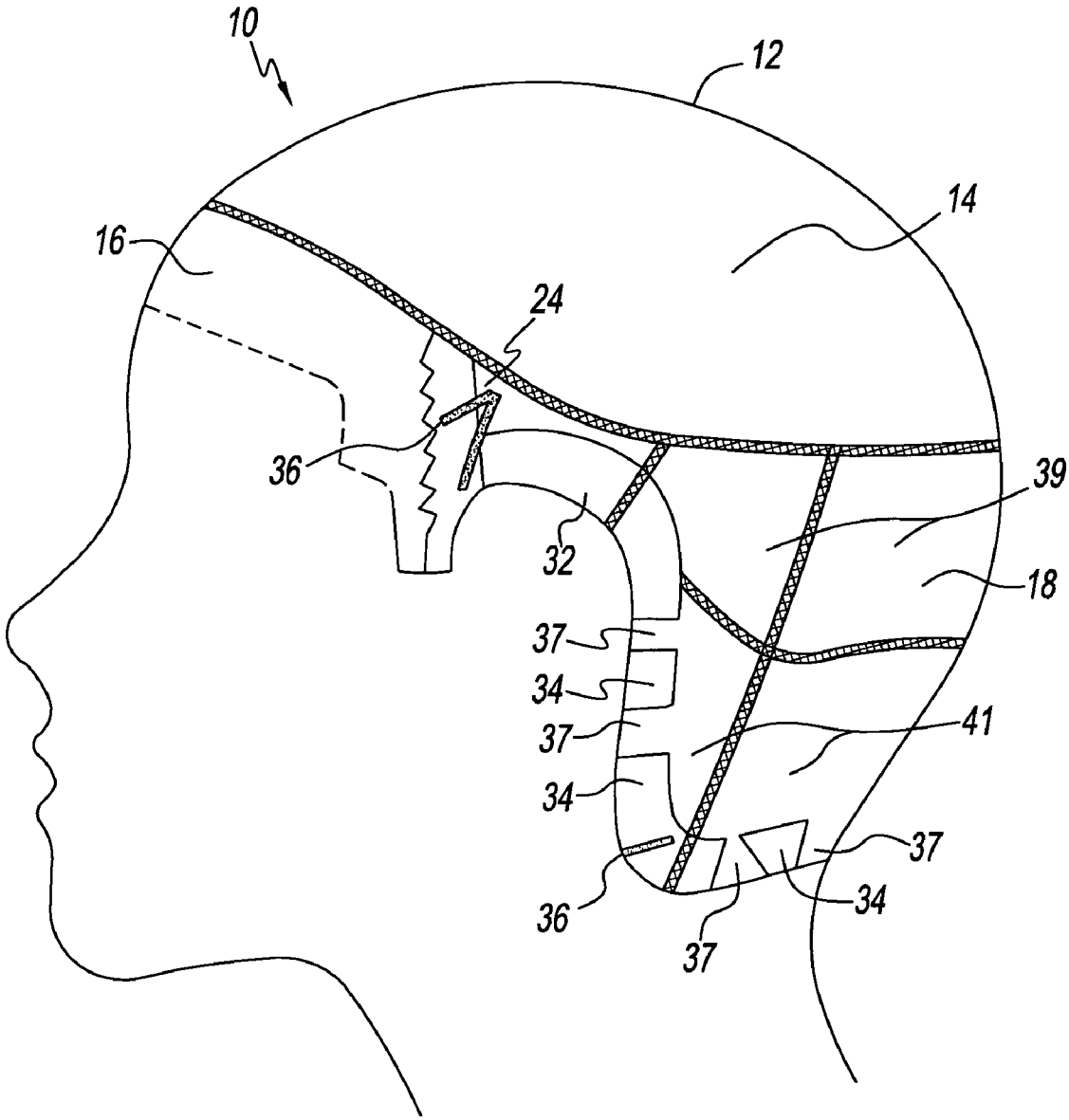
FIG. 9 illustrates a side view of a fifth exemplary embodiment of the hair prosthesis according to the present disclosure.
Figure 10:
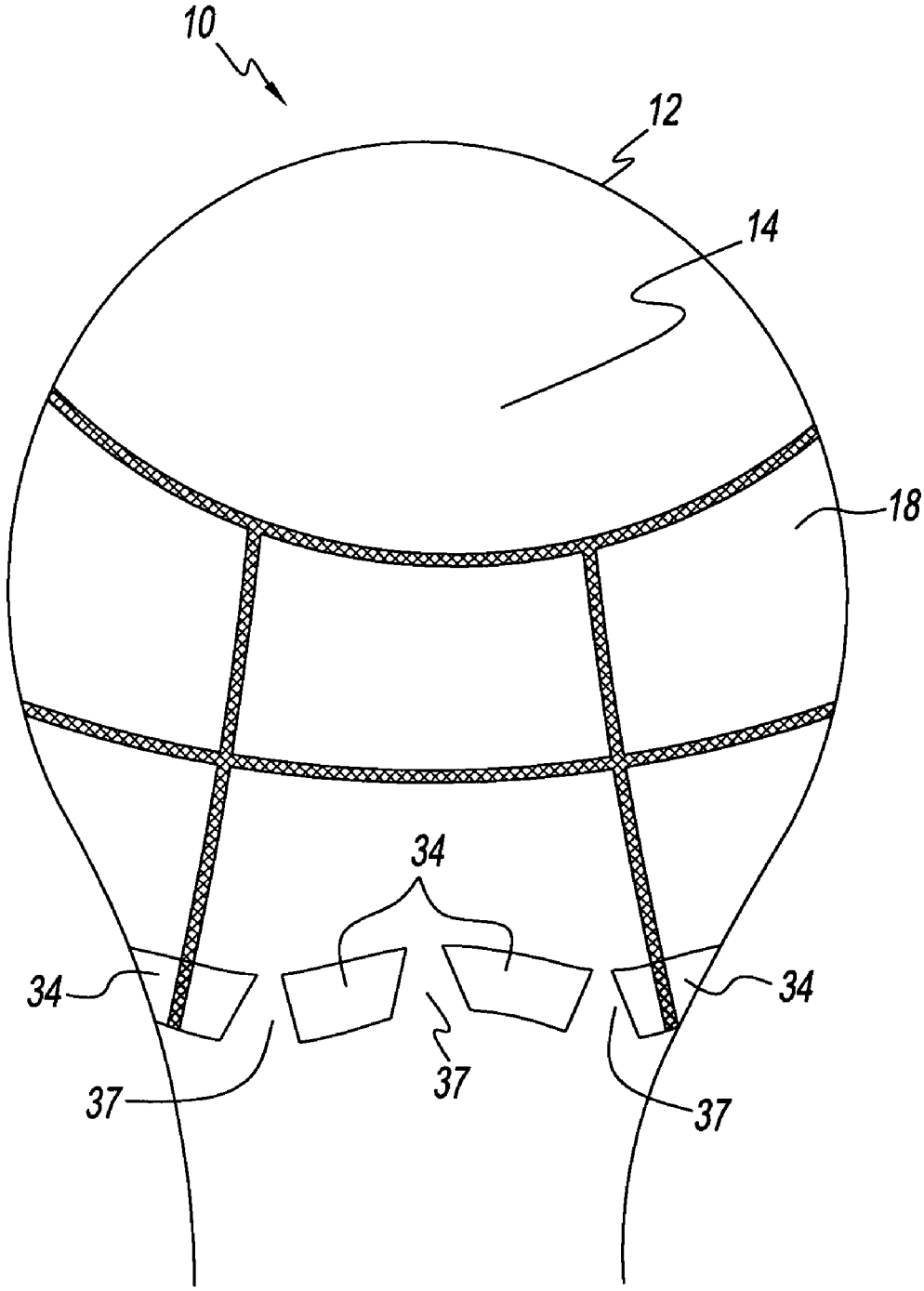
FIG. 10 illustrates a rear view of the hair prosthesis of FIG. 9.

The embodiments shown in FIGS. 8, 9 and 10 are the same as FIGS. 6 and 7, except for the following: FIG. 8 shows front section 16 is made of the thin (HD2) lace, along with an alternative placement of breaks or contour adjustments 37, and FIGS. 9 and 10 show front section 16 is be made of either thin (HD2) lace or nylon (HD1) lace, and an alternative placement of breaks or contour adjustments 37.

Figure 11:
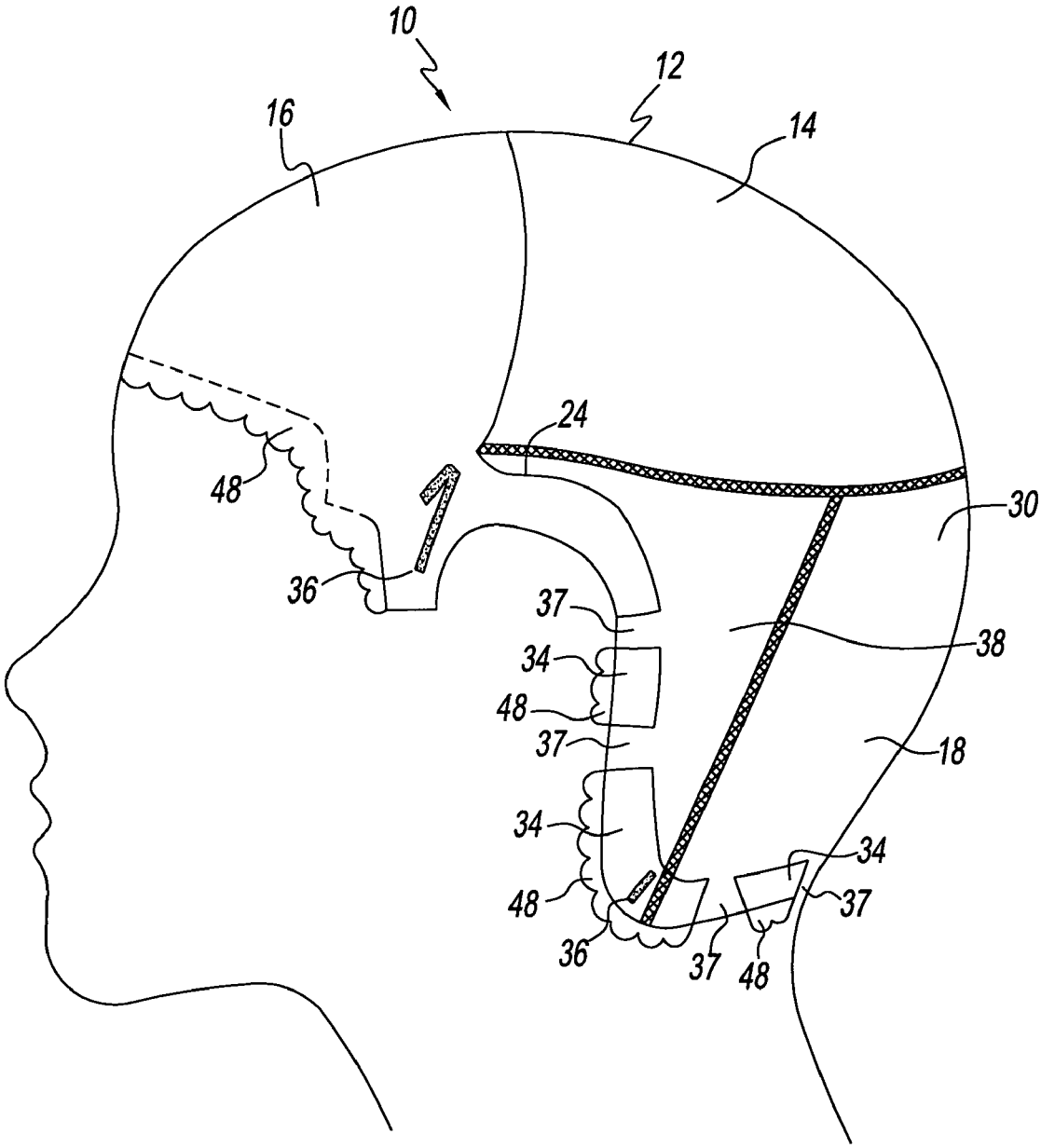
FIG. 11 illustrates a side view of a sixth exemplary embodiment of the hair prosthesis according to the present disclosure.
Figure 12:
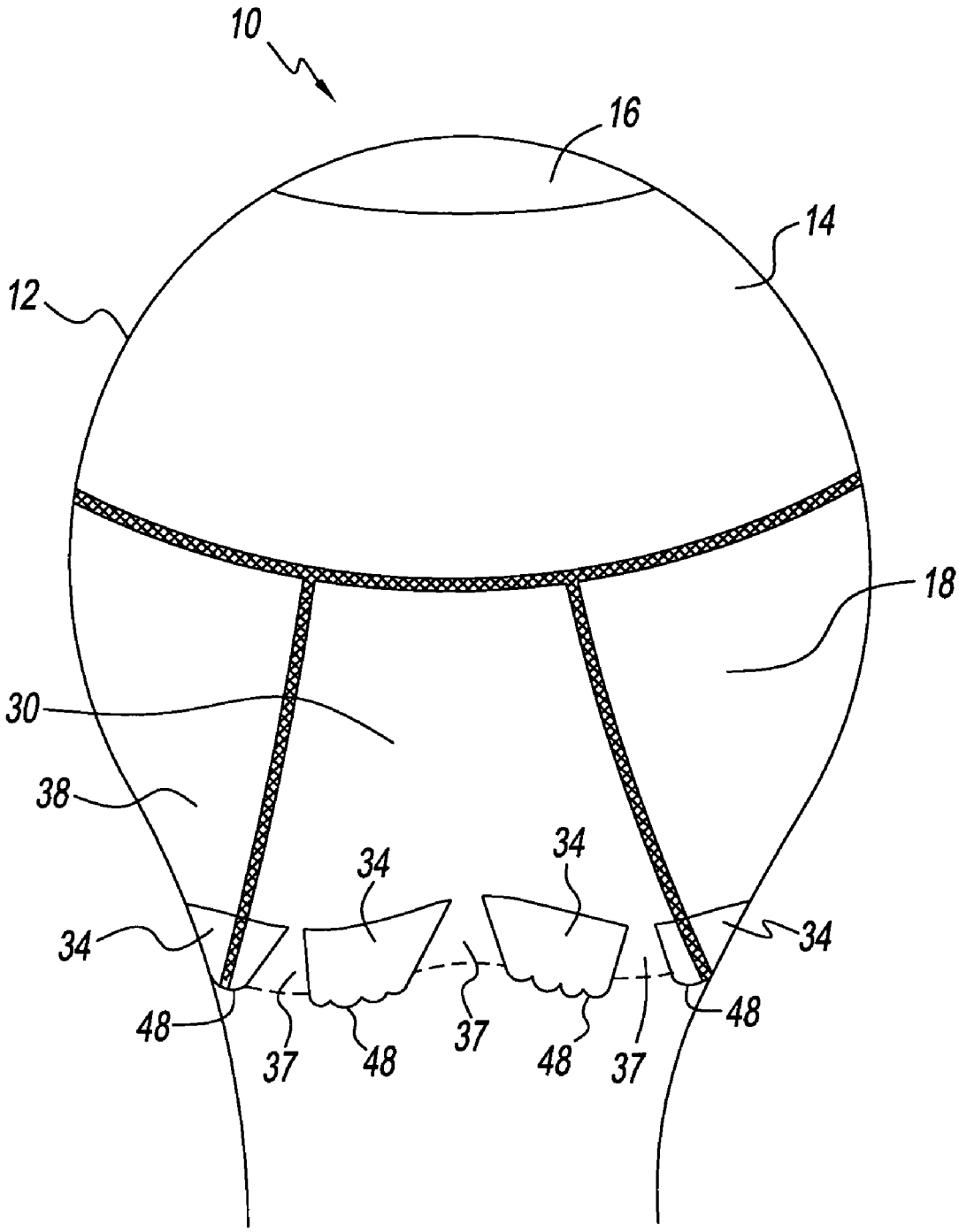
FIG. 12 illustrates a rear view of FIG. 11.

In FIGS. 11 and 12, front section 16 extends to the top of the wearer's head into crown section 14. This provides a natural appearance should the wearer part the hair of hair prosthesis 10. Front section 16 is made of nylon (HD1) lace coated entirely with one to three layers of either polyurethane coating 34 or silicone coating 32, forming what is called a thin skin. A nude coloring can be applied the coating to provide the look of skin after the coating dries on the lace. This is flexible and smooth, and when hair is ventilated, it looks as if it is growing out the wearer's scalp. The coating applied to front section 16 is continuous to back section 18.

Crown section 14 is made of nylon (HD1) lace and may contain a number of holes 39 (not shown) which are about 5 mm in diameter. Back section 18 is made of thin stretch (HD3) lace. Further, polyurethane coating 34 is applied to the lower ends of side portions 38 and central portion 30, with breaks or contour adjustments 37. The edges of base or foundation 12 that surrounds the face of the wearer and along the nape of the neck contain a scalloped edge 48. Scalloped edge 48 is used for a wearer that has thinning hair along the hairlines. This allows the wearer's own hair to be visible in order to provide a more natural hairline. Scalloped edge 48 lies behind the wearer's natural hairline allowing the wearer to comb his/her own hair over the edge of hair prostheses 10. This blends the wearer's hair into hair prosthesis 10 providing the illusion that the wearer has not lost hair. Wire 36 is placed at temple portions 24 and side portions 38.

Figure 13:
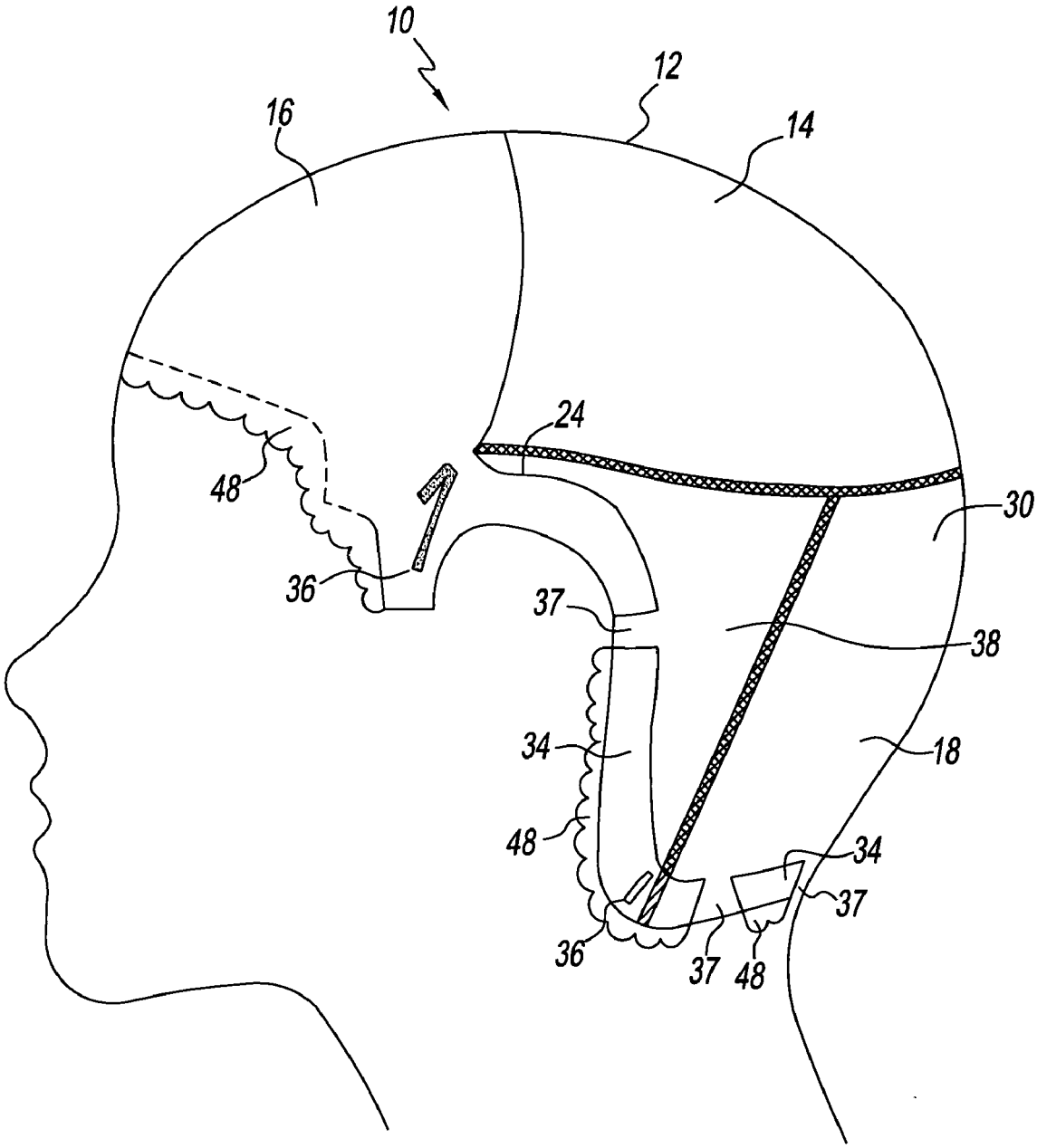
FIG. 13 illustrates a side view of a seventh exemplary embodiment of the hair prosthesis according to the present disclosure.

The embodiment of FIG. 13 is the same as FIG. 11, expect FIG. 13 shows that polyurethane coating 34 is applied to the lower ends of side portions 38 and central portion 30, and there is an alternative placement of breaks or contour adjustments 37.

Figure 14:
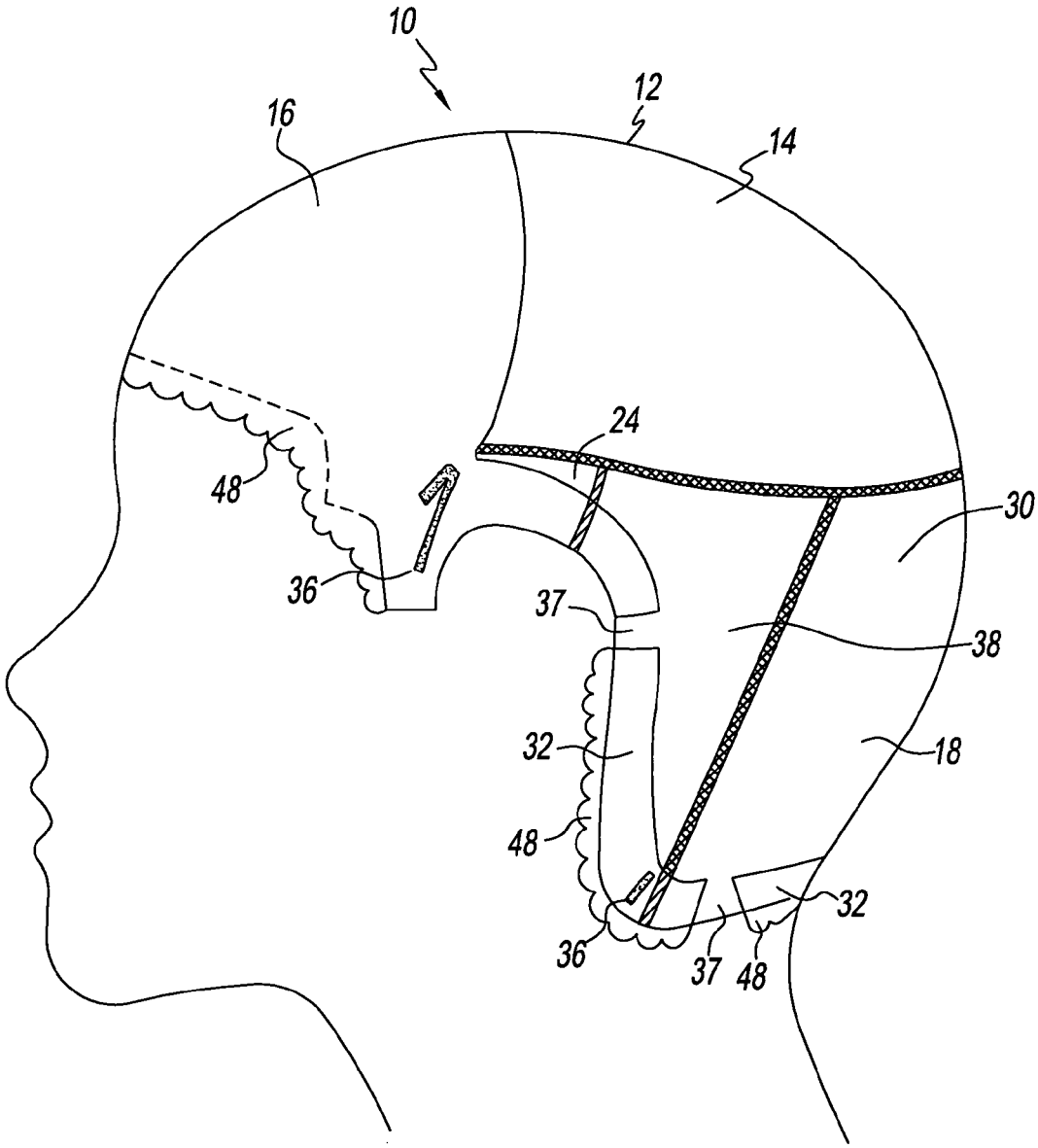
FIG. 14 illustrates a side view of a eighth exemplary embodiment of the hair prosthesis according to the present disclosure.

The embodiment of FIG. 14 is the same as FIG. 11, expect FIG. 14 shows one to three layers of silicone coating 32 applied on front section 16 and continuously to back section 18 to form a thin skin. Silicone coating 32 is applied to the lower ends of side portions 38 and central portion 30 to form a thin skin. Also, there is an alternative placement of breaks or contour adjustments 37.

Figure 15:
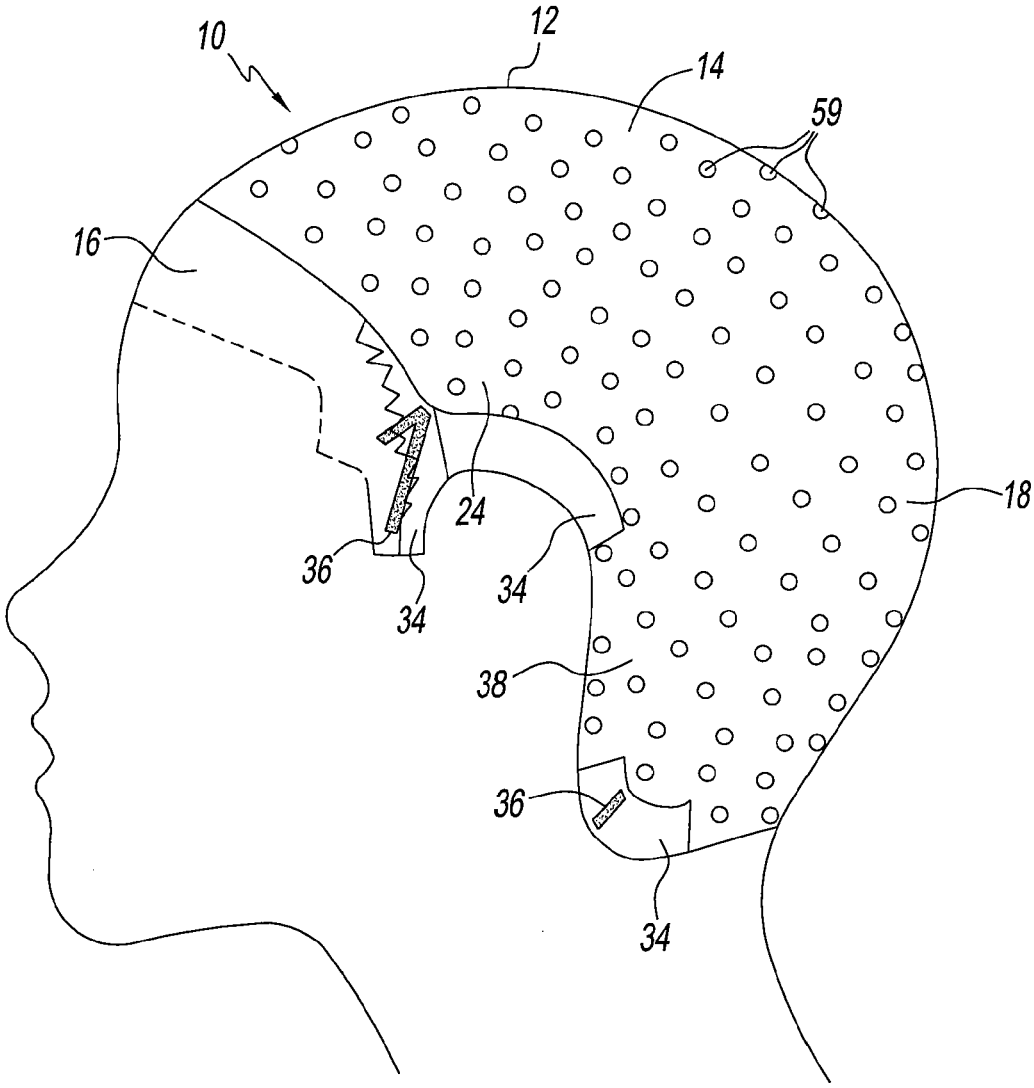
FIG. 15 illustrates a side view of a ninth exemplary embodiment of the hair prosthesis according to the present disclosure.
Figure 16:
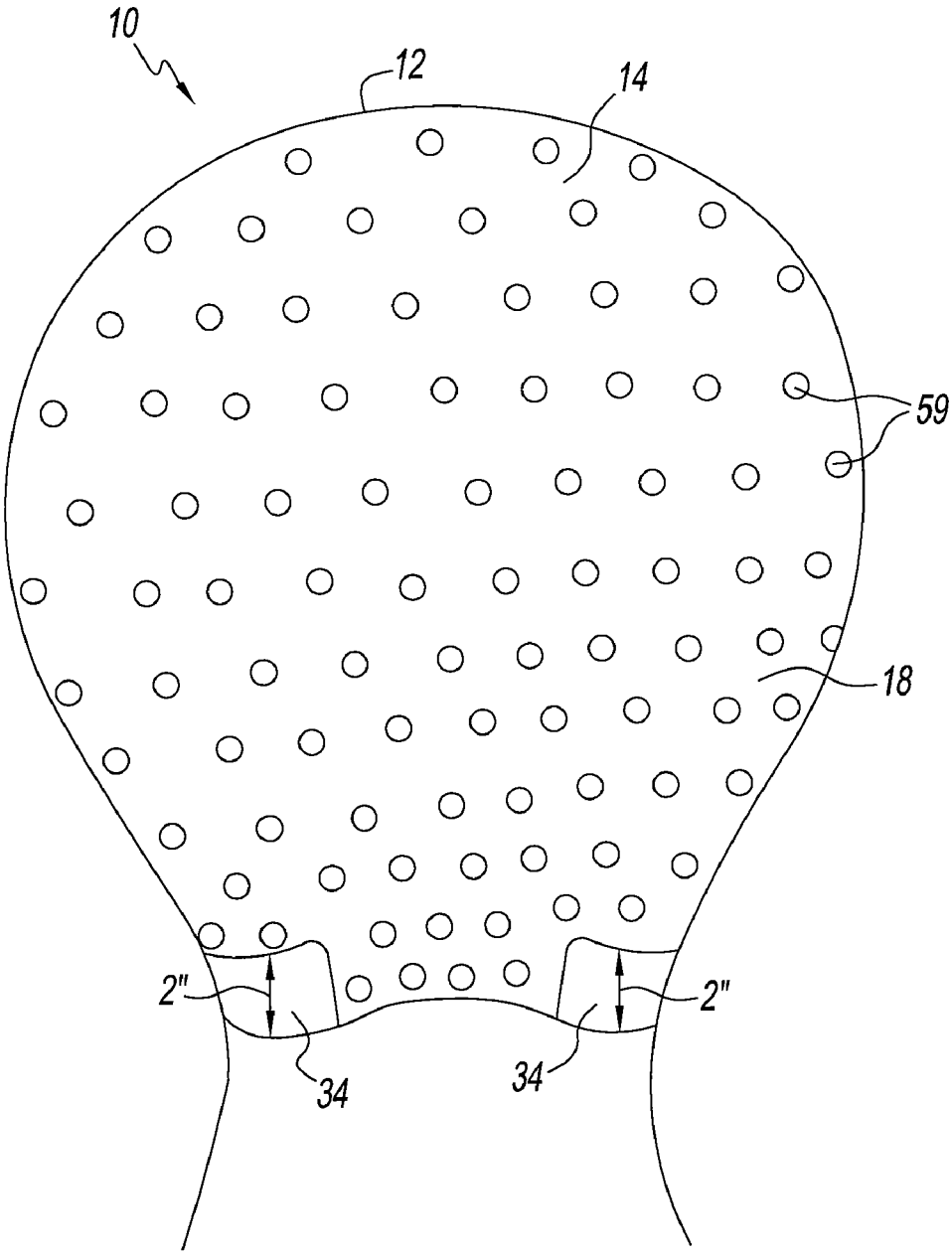
FIG. 16 illustrates a rear view of FIG. 15.
Figure 17:
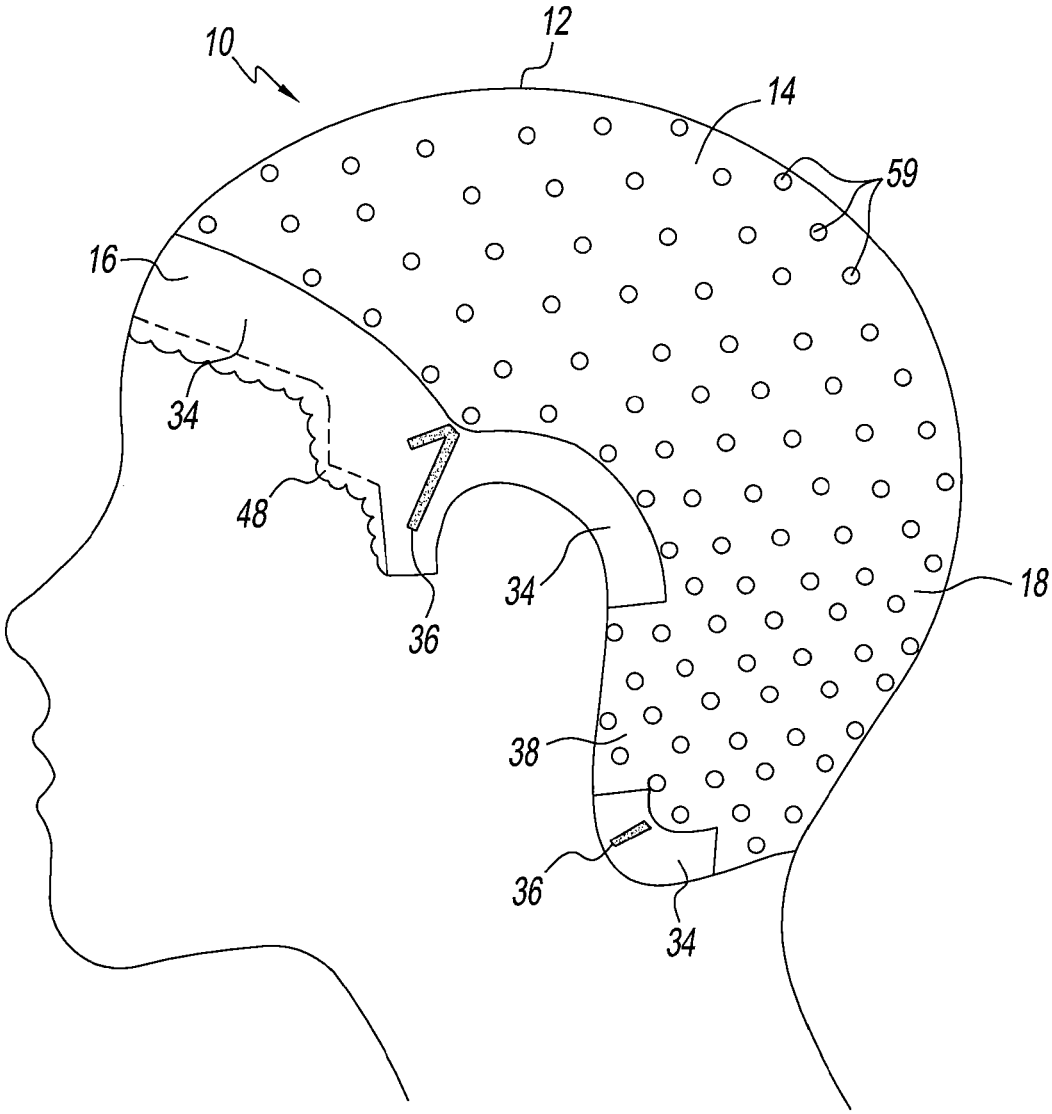
FIG. 17 illustrates a side view of a tenth exemplary embodiment of the hair prosthesis according to the present disclosure.

In the embodiments of FIGS. 15, 16 and 17, front section 16 is made of nylon (HD1) lace, crown section 14 and back section 18 are made entirely of thin stretch (HD3) lace or glass gauze, which is a transparent silk fiber about 1 mm, preferably 1 mm, thick, that is completely coated with one to three layers of silicone coating 32 or polyurethane coating 34 to form a thin skin. Crown section 14 and back section 16 contain a number of holes 59. Each hole is about 5 mm, and preferably 5 mm in diameter. Wire 36 is placed at temple portions 24 and side portions 38.

Also, in FIGS. 15 and 16, a double layer of polyurethane coating 34 measuring about 2 inches, and preferably 2 inches, wide is applied along temple portions 24 continuous to back section 18, and also on the lower corners of side portions 38.

In FIG. 17, a double layer of polyurethane coating 34 is applied to the entire front section 16 and continuously to back section 18, and also on the lower corners of side portions 38. In addition, the edges of front section 16 surrounding the face of the wearer contain scalloped edge 48.

Figure 18:
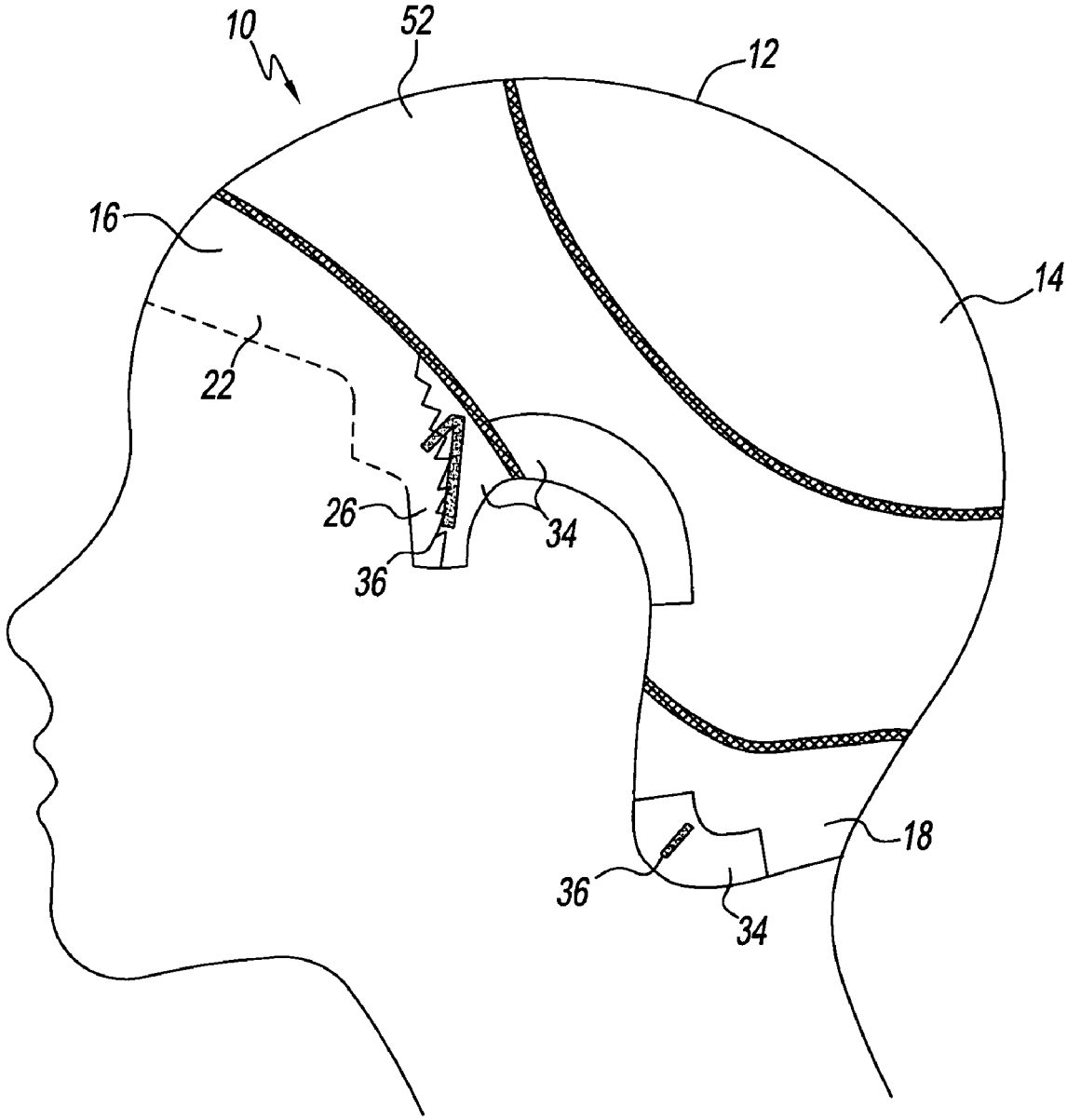
FIG. 18 illustrates a side view of an eleventh exemplary embodiment of the hair prosthesis according to the present disclosure.
Figure 19:
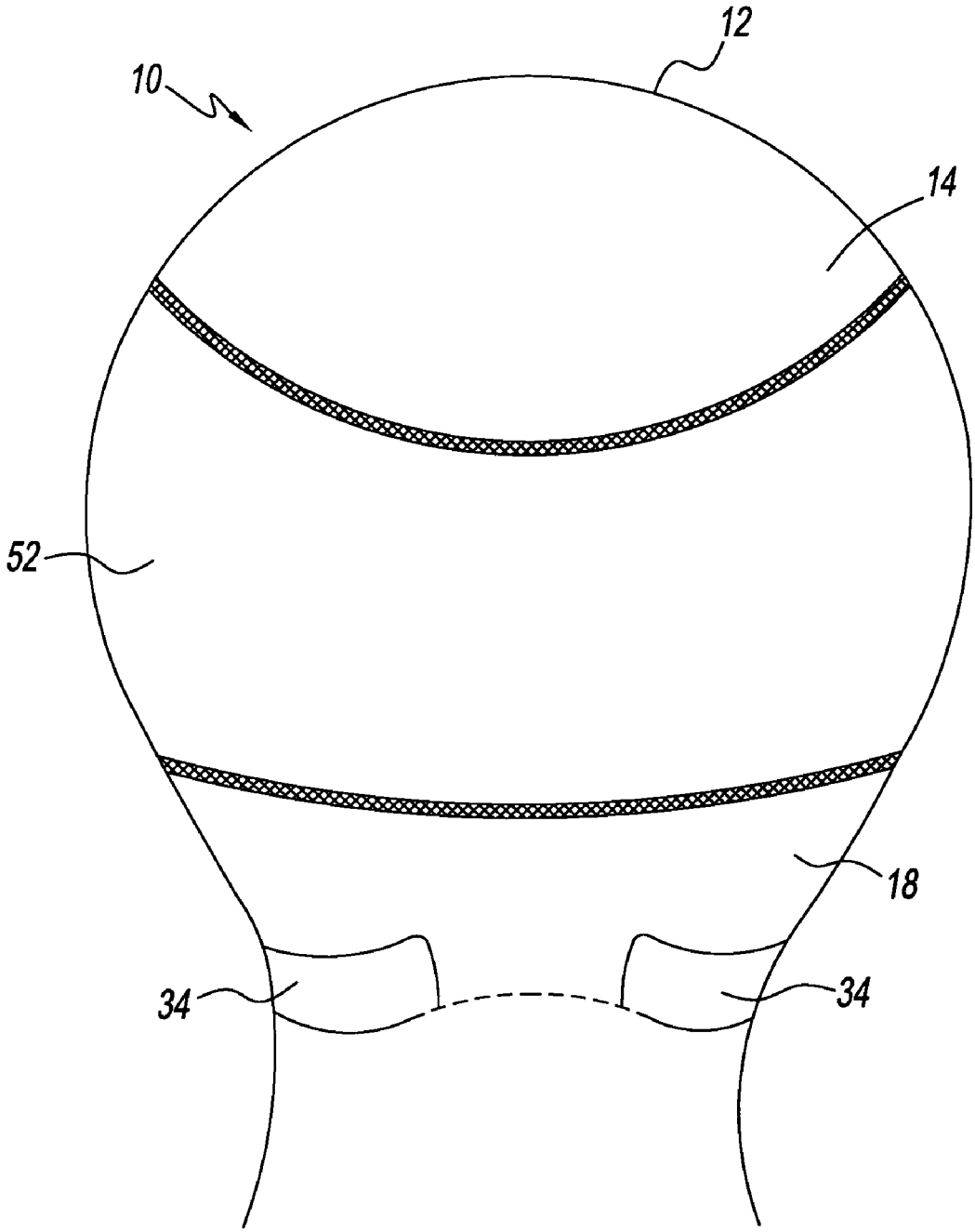
FIG. 19 illustrates a rear view of FIG. 18.

In the embodiments of FIGS. 18 and 19, base or foundation 12 is composed of front section 16 made of nylon (HD1) lace or thin (HD2) lace, crown section 14 made of thin stretch (HD3) lace, a middle section 52 between front section 16 and crown section 14 is made of the nylon lace and a smaller back section 18 is made of two layers of the nylon lace. Polyurethane coating 34 is applied on temple portion 24 into sideburn portions 26. Polyurethane coating 34 is also applied along the edge of middle section 52 above the wearer's ear and on the lower ends of back section 18. Polyurethane coating 34 is about 2 inches, and preferably 2 inches, wide. Wire 36 is placed at sideburn portions 26 and side portions 38.

Figure 20:
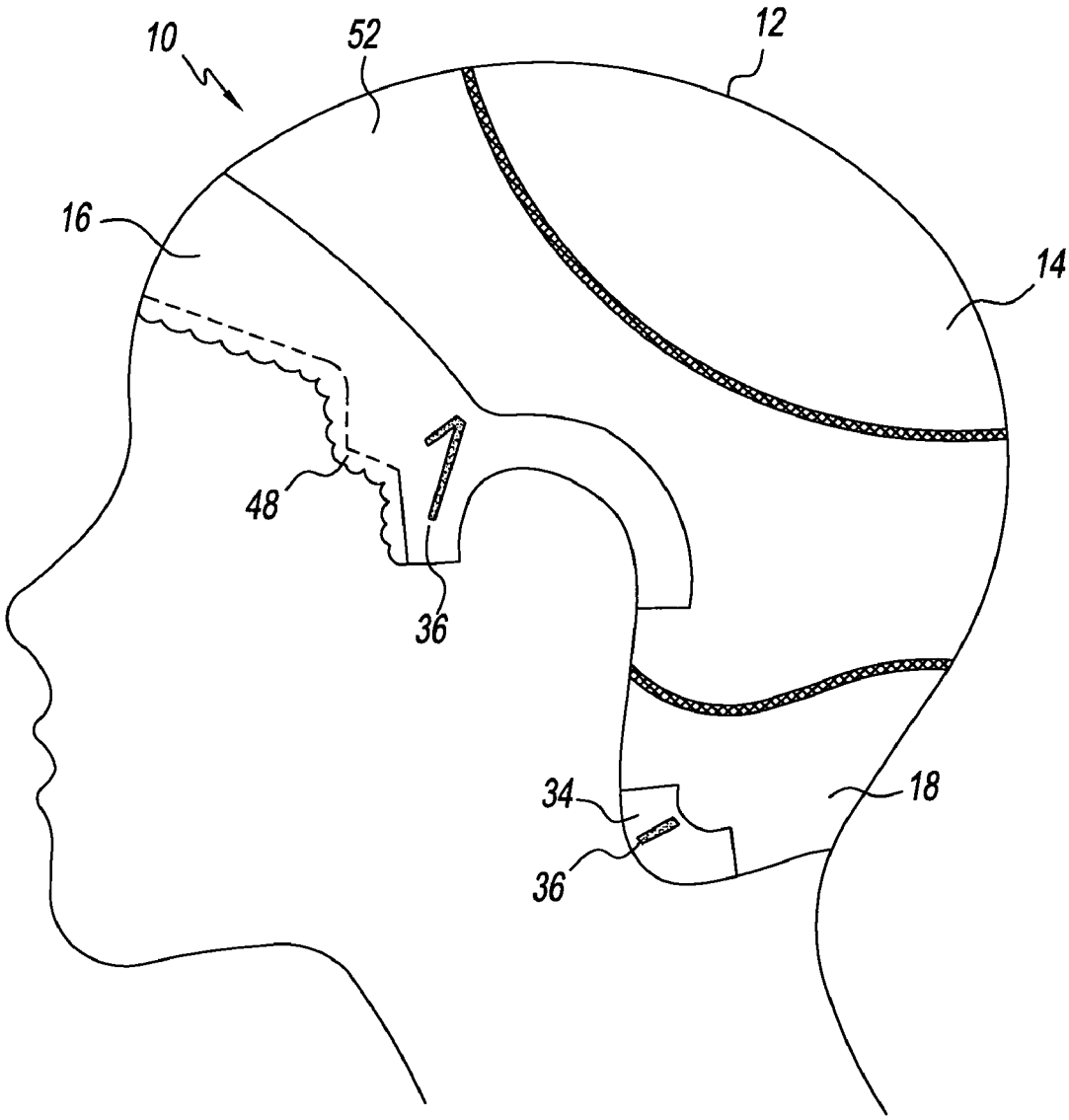
FIG. 20 illustrates a side view of a twelfth exemplary embodiment of the hair prosthesis according to the present disclosure.

The embodiment of FIG. 20 is the same as FIG. 18, except in FIG. 20 front section 16 is made of nylon (HD1) lace or thin (HD2) lace coated entirely with one to three layers of either polyurethane coating 34 or silicone coating 32 forming a thin skin. The coating applied to front section 16 is continuous to middle section 52. The edges of front section 16 surrounding the face of the wearer contain scalloped edge 48.

Figure 21:
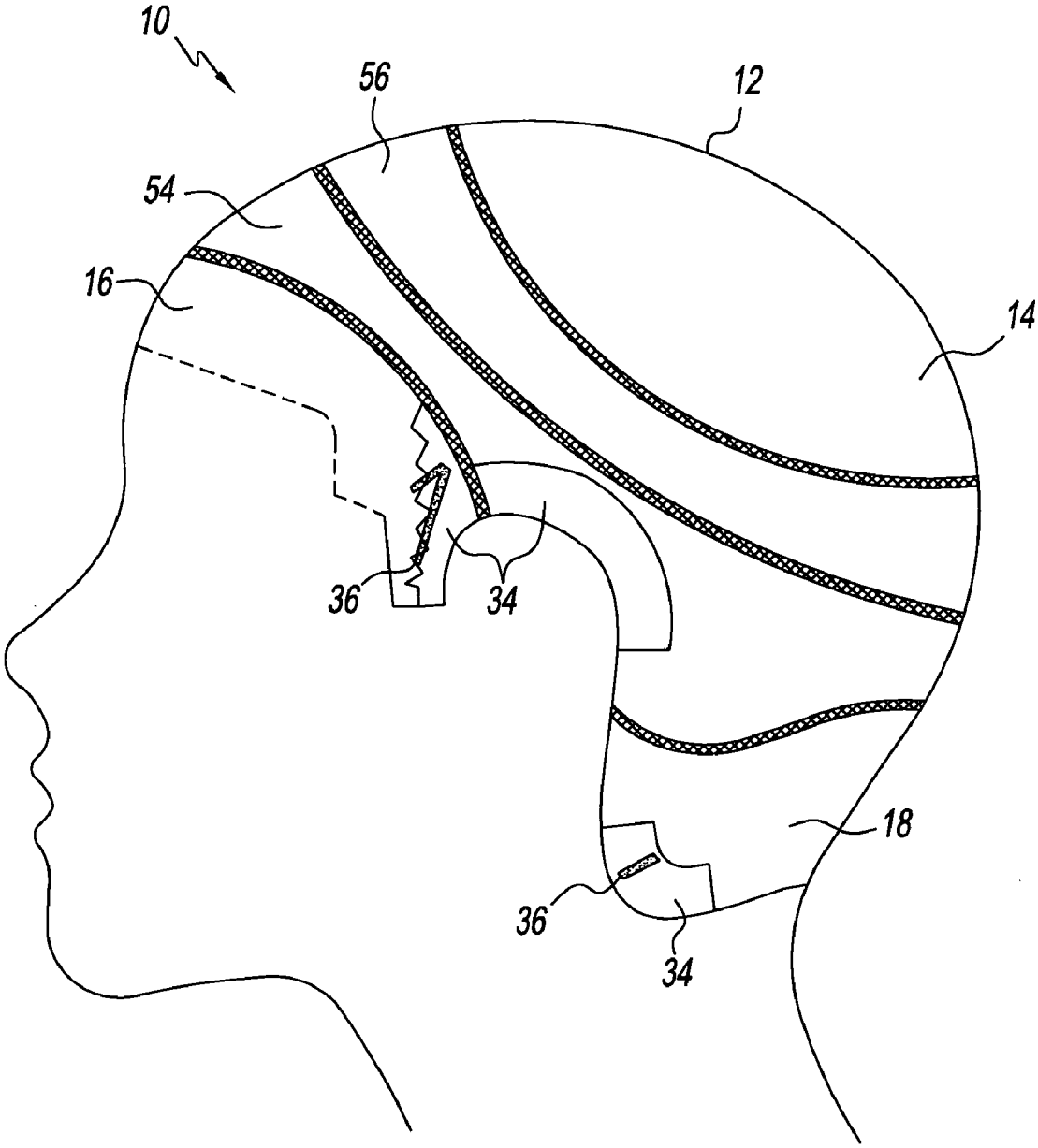
FIG. 21 illustrates a side view of a thirteenth exemplary embodiment of the hair prosthesis according to the present disclosure.
Figure 22:
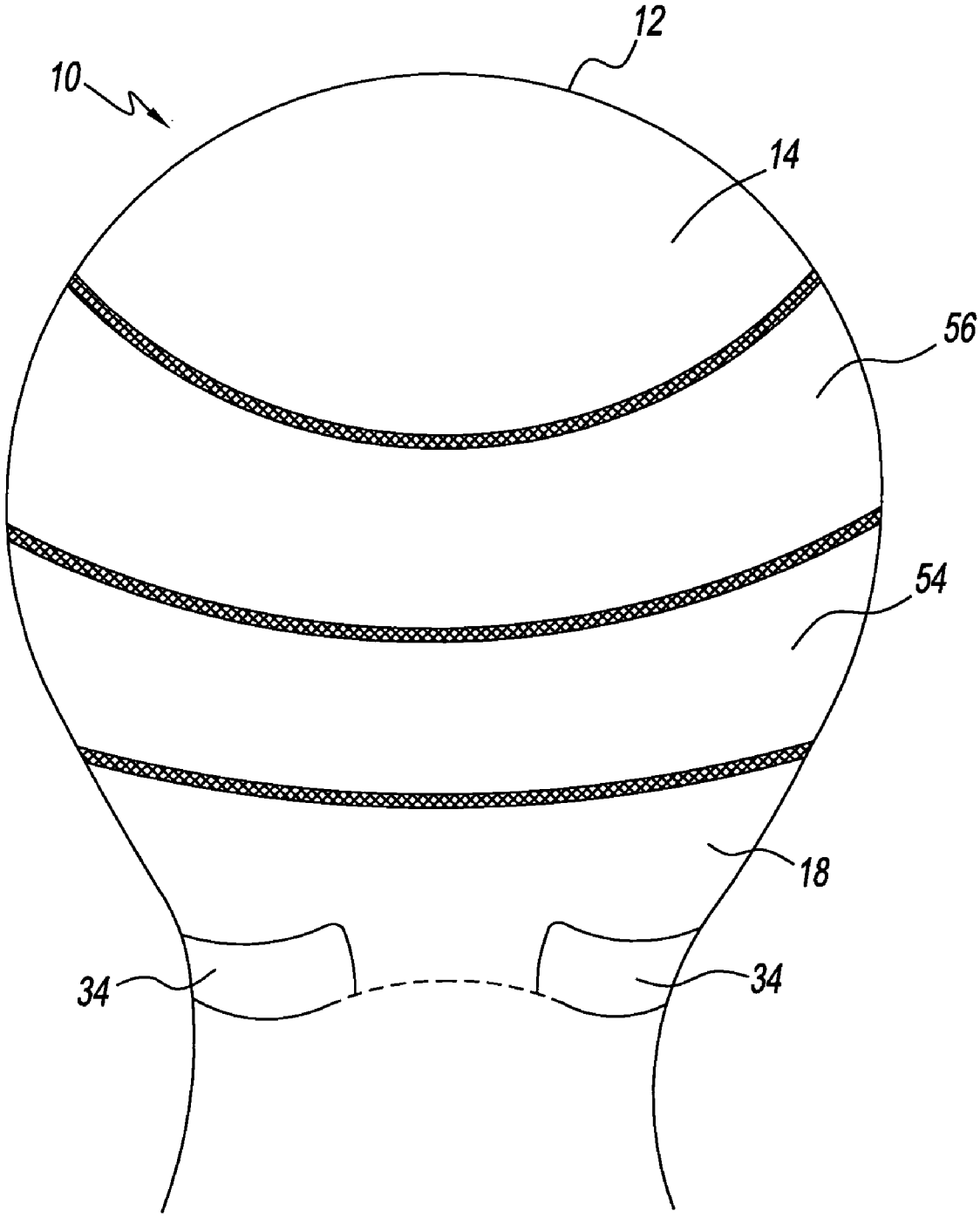
FIG. 22 illustrates a rear view of FIG. 21.

The embodiments of FIGS. 21 and 22, are the same as FIGS. 18 and 19, except middle section 52 has a first middle section 54 made of thin stretch (HD3) lace and a second middle section 56 made of nylon (HD1) lace. First middle section 54 allows hair prosthesis 10 to stretch and therefore provide a better fit for the wearer, while section middle section 56 provide support and maintain the shape of hair prosthesis 10 after prolonged use.

Figure 23:
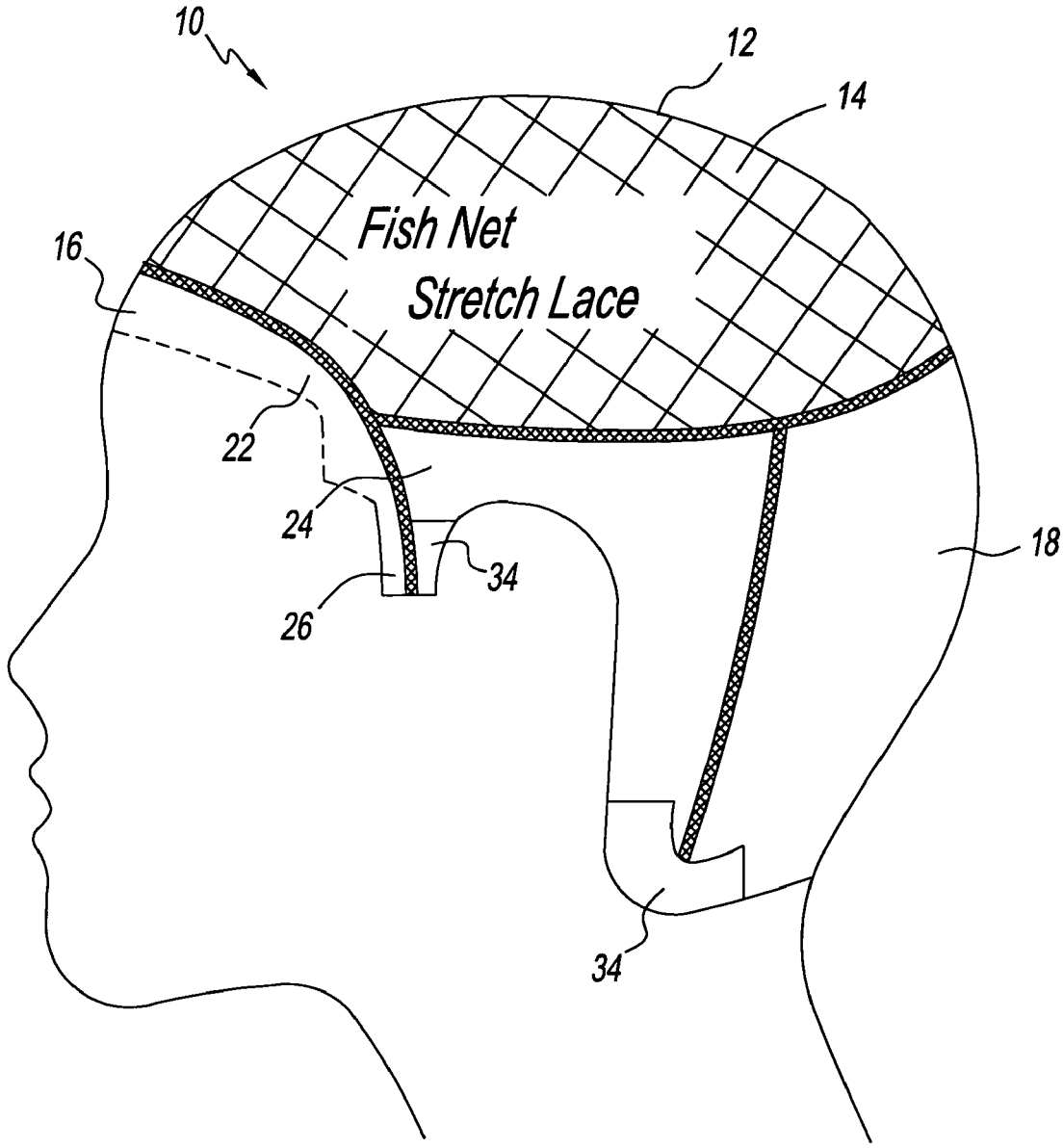
FIG. 23 illustrates a side view of a fourteenth exemplary embodiment of the hair prosthesis according to the present disclosure.
Figure 24:
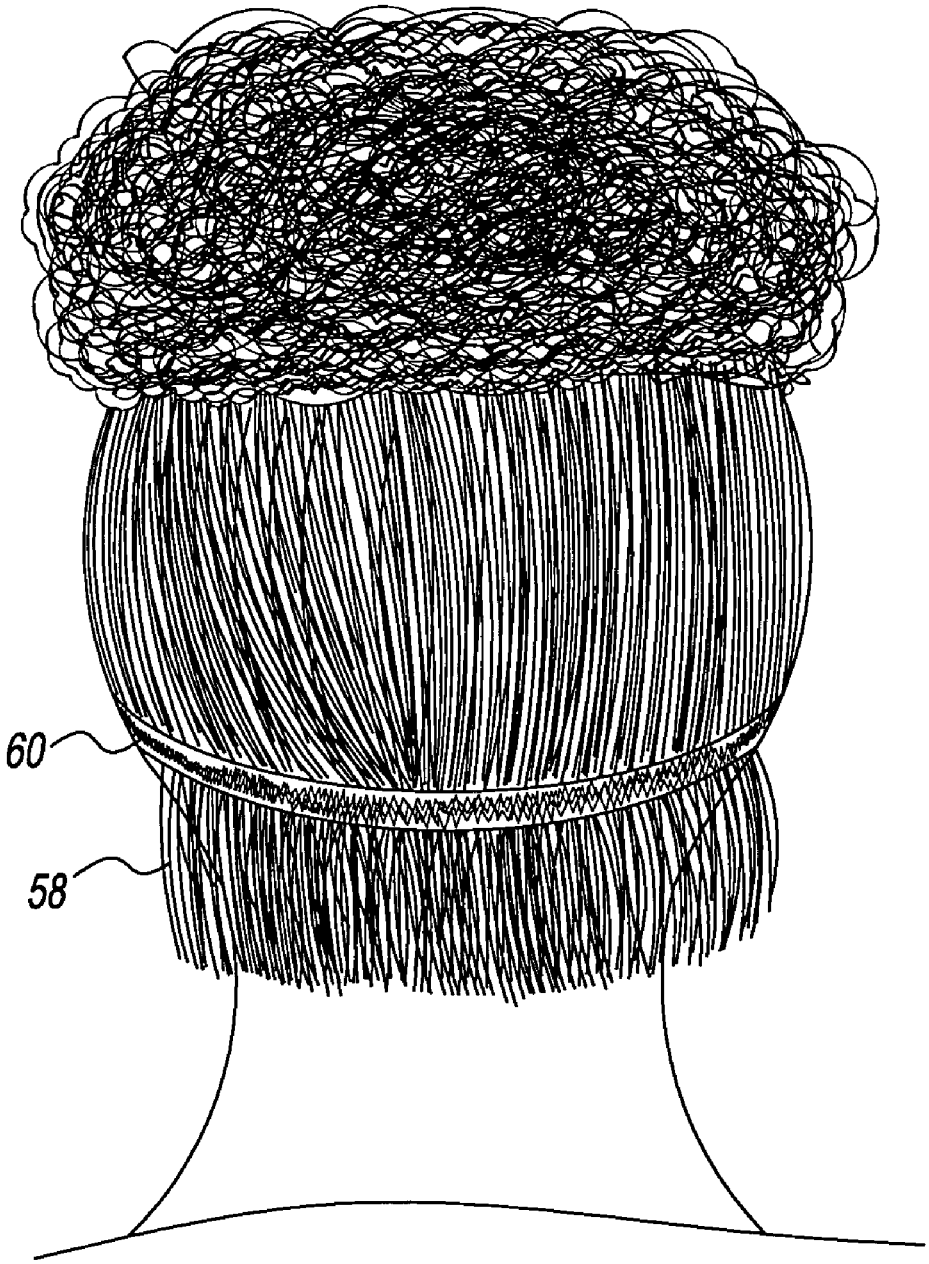
FIG. 24 illustrates a rear view of head and harvesting of the hair.

In the embodiment of FIG. 23, medical hair prosthesis 10 is a lighter weight, breathable design that chemotherapy and alopecia patients can utilize at the gym, during vigorous outdoor activity or casually lounging indoors. Crown section 14 is made of a fish net stretch lace made from a stretch cotton fiber with about ½ cm, preferably ½ cm, wide diamond shaped holes. Crown section 14 is left void of hair allowing the scalp of the wearer to breathe and for perspiration to evaporate easily. Thus, the embodiment of FIG. 23 may be worn with a hat, cap, scarf or head wrap over crown section 14.

Front section 16 is made of nylon (HD1) lace with hair attached by single-strand ventilation to recreate a natural hairline. Temple portions 24 and an inner half of sideburn portions 26 are made of either thin stretch (HD3) lace or 100% spandex with wefts of hair (not shown) sewn in at a 45 degree angle. A weft of hair is a number of strands of hair that have been sewn together at the roots. The hair at the sides and temple of a head naturally grows backward toward the back of the head. Placing wefts at a 45 degree angle allows for a more natural flow and fall of the hair from hair prosthesis 10.

Back section 18 is made of either thin stretch (HD3) lace or 100% spandex with wefts of hair (not shown) sewn in horizontally starting from ear to ear down to the nape of the neck. The hair at the back of the head naturally grows downward. Placing wefts horizontally mimics the growth and flow of natural hair. Wefts are spaced about 1 inch apart.

Polyurethane coating 34 is applied on the inner half of sideburns 26 and on the lower ends of back section 18. This allows the wearer to use double sided tape to secure hair prosthesis 10 to their head.

In an exemplary embodiment, hair prosthesis 10 comes in three basic sizes, namely small, medium and large. Small is 48 cm, medium is 52 cm and large is 56 cm. These measurements represent the circumference of the head, starting at hairline portion 22, moving around above the ears and down to the nape of the neck and back up around to hairline portion 22. These measurements were determined by those in the hair prosthesis field to fit a wide spectrum of wearers and allow for minimal alterations to base or foundation 12.

In another embodiment, the wearer's own hair is used in the front hairline of hair prosthesis 10. This process is referred to as harvesting. Harvesting is used so that the person's look is maintained in hair prosthesis 10. Accordingly, before chemotherapy commences, the wearer's own hair is pined up to the top of their head. The harvesting begins at the nape of the neck where a horizontal row of hair is sectioned off to form a first section 58 of hair. First section 58 is allowed to fall freely down the nape of the neck. Above first section 58, a second section 60 of hair is sectioned off. Second section 60 is a horizontal row of hair that is cut about 2 to 3 inches, preferably 2 to 3 inches, from the root. The cut hair is collected and fastened together by magic tape or twine.

The above steps for harvesting are repeated, moving upwards toward the crown of the person's head. Harvesting from the back of a person's head up to the crown supplies sufficient hair to incorporate into the front hairline of hair prosthesis 10.

After sufficient hair is removed, the remaining hair of the person is restyled. The person's hair may appear less voluminous; however, the person's look is still cosmetically acceptable. This look can be kept until the person's hair begins to fall off from treatments received. At that time, hair prosthesis 10 will be available with the person's own hair incorporated into the front hairline.

The harvesting process takes about 15 to 20 minutes. The hair is harvested during one session. Each harvested hair is attached to base or foundation 12 by single-strand ventilation. A knotting ventilation technique is most commonly used in lace based hair prosthesis.

Figure 25:
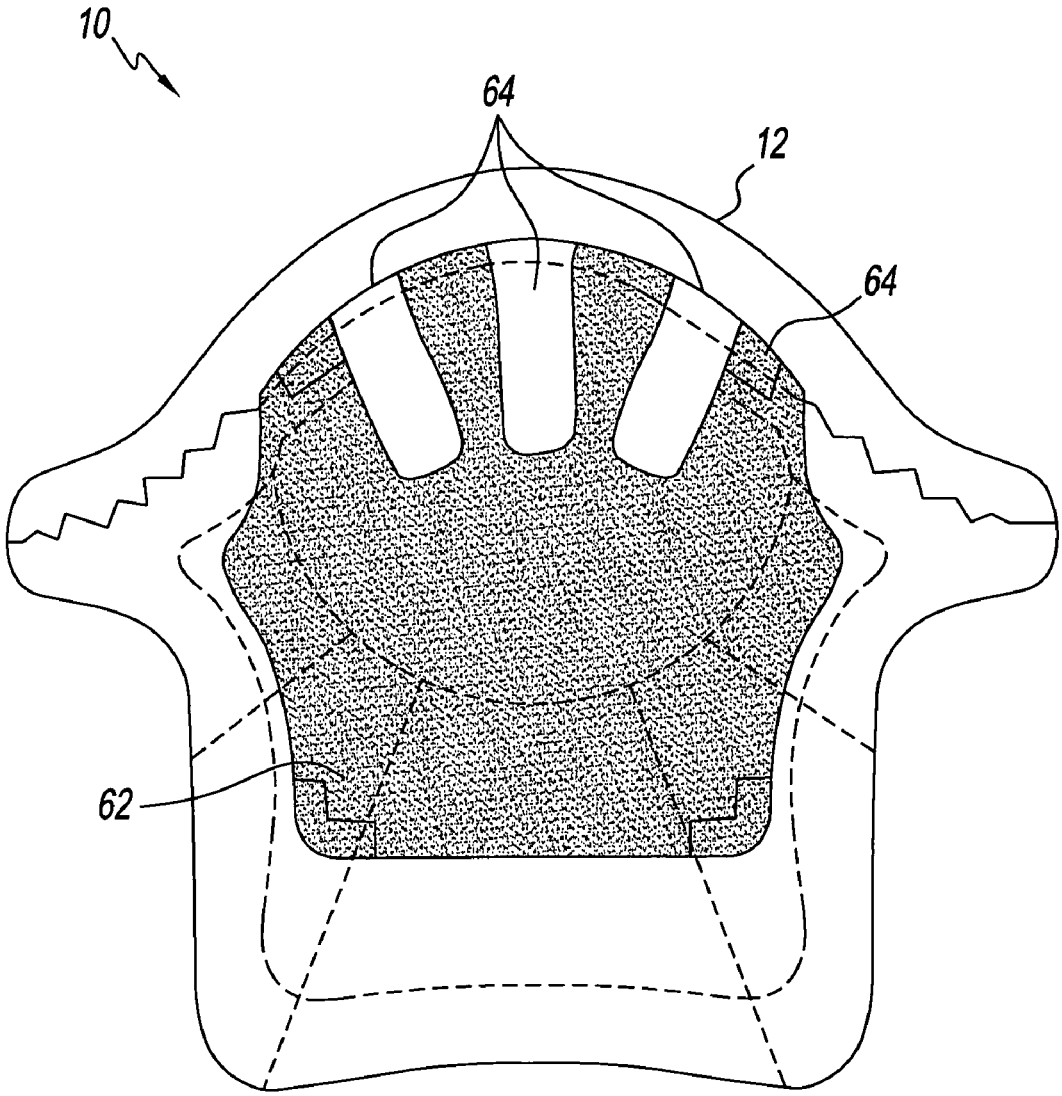
FIG. 25 illustrates a top view of the skullcap.
Figure 26:
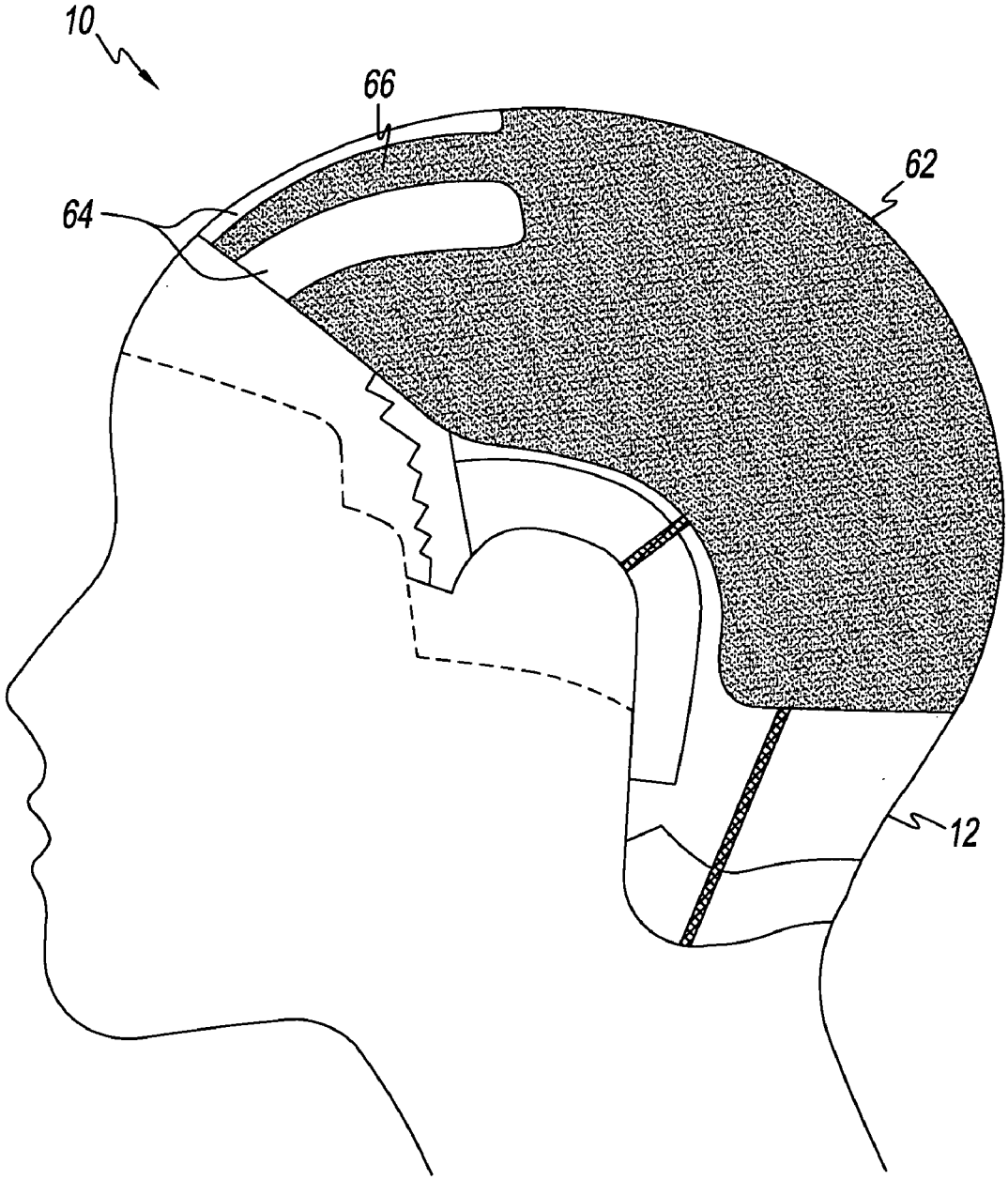
FIG. 26 illustrates a side view of the skullcap of FIG. 25.
Figure 27:
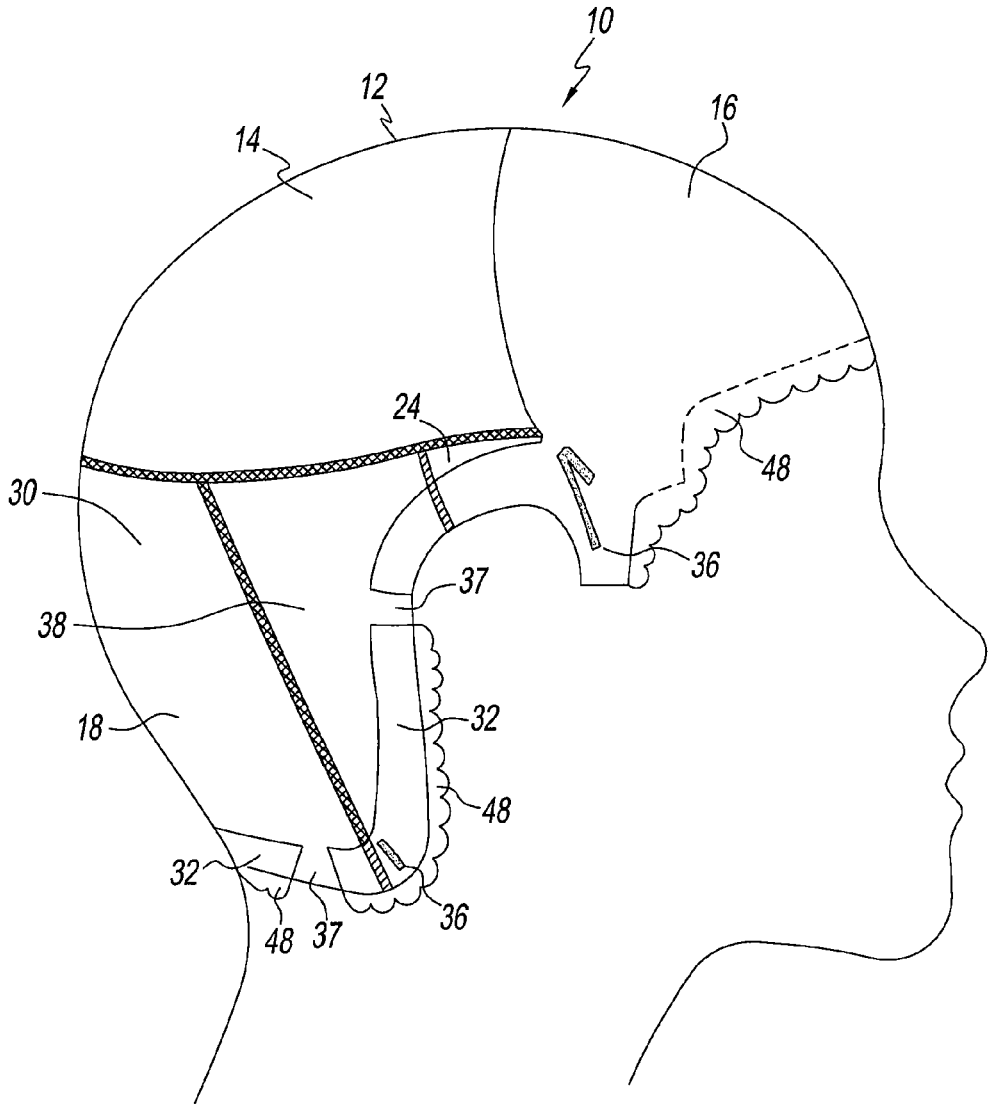
FIG. 27 illustrates a side view, opposite the side view of FIG. 14, of the eighth exemplary embodiment of the hair prosthesis according to the present disclosure.

In another embodiment, referred to in FIGS. 25 and 26, a skullcap 62 can be used to prevent skin irritation from base or foundation 12 of hair prosthesis 10. Skullcap 62 is made of an anti bacterial cotton material. The material protects the wearer's scalp from skin irritation, absorbs perspiration and prevents excessive body heat loss from the top of the head.

The front section 66 has at least three rectangles 64 cut out of skullcap 62. Rectangles 64 are about 4½ by 1¾, and preferably 4½ by 1¾, inches and contain a lace that is 100% nylon. Rectangles 64 correspond to the center and sides of the top of the scalp where a person normally parts his/her hair. This allows the wearer to part the hair of hair prosthesis 10 without exposing skullcap 62, thus providing a natural look.

Furthermore, skin may become irritated or inflamed from the prolonged use of adhesive to attach hair systems to the scalp. Over time these irritations can lead to welts and even sores. To prevent this from occurring, scalp guard can be applied to the scalp. Scalp guard provides an invisible barrier between the scalp and adhesive used to attach hair systems. Scalp guard is an alcohol based liquid containing a polymer. It is available in a dab-on applicator to gently glide across the scalp. When tape is removed, all the pull stress is now on the scalp guard and not on the wearer's scalp.

Scalp guard is applied to the scalp between hair system wearing. The scalp is cleaned of any adhesive residue remaining on scalp after removal of a hair system. A thin layer of scalp guard is applied to the scalp with dab-on applicator. The scalp will then dry rapidly allowing the hair system to be reapplied with minimal waiting time.

In addition, because human hair is porous and absorbs water, hair systems made of human hair will loss the hair over time due to numerous washings. To prevent this, the inside of the foundation of human hair systems can be sprayed with knot sealer after washings. Knot sealer is an acetone and resin based liquid that forms a protective coating on the knots in the foundation. The knot sealer makes the knots less impervious to water, thus resulting in a decrease in the loss of hair over time.

The present disclosure having been thus described with particular reference to the preferred forms thereof, it will be obvious that various changes and modifications may be made therein without departing from the spirit and scope of the present disclosure as defined in the disclosure.

What is claimed is:

1. A medical hair prosthesis for a wearer comprising:

a base having a crown section, a front section contiguous to said crown section and a back section contiguous to said front section and said crown section, said front section including a hairline portion, said base composed of a lace, said lace having been treated by a cryogenic process to enhance the strength and durability of said base;

a plurality of hairs attached to said base, said plurality of hairs including a portion that is the natural hair of the wearer and the remainder is synthetic fibers, wherein only the wearer's natural hair obtained by harvesting is attached to the hairline portion;

at least one coating applied to said base to secure said plurality of hairs in place; and at least two wires attached to said front section to provide ease of contouring said medical hair prosthesis to said wearer's scalp.

2. The medical hair prosthesis according to claim 1, wherein said crown section contains a crown seam to reinforce and maintain shape.

3. The medical hair prosthesis according to claim 1, wherein said front section contains a hairline portion, a pair of temple portions and a pair of sideburn portions.

4. The medical hair prosthesis according to claim 3, wherein said lace of said hairline portion is made of a thin 100% nylon that is thinner than said lace of said crown section.

5. The medical hair prosthesis according to claim 1, wherein said back section contains a pair of side portions and a central portion.

6. The medical hair prosthesis according to claim 5, wherein said lace of said pair of side portions are made of a thin 100% nylon that is thinner than said lace of said crown section.

7. The medical hair prosthesis according to claim 5, wherein said lace of said central portion is composed of a thin 100% nylon that is thinner than said lace of said crown section.

8. The medical hair prosthesis according to claim 1, wherein said cryogenic process entails lowering the temperature of said lace to about −300 degrees F. over 3 to 4 hours, holding the temperature at about −300 degrees F. for 2 to 3 hours, and then returning said lace to ambient temperature over 3 hours.

9. The medical hair prosthesis according to claim 1, wherein said at least one coating contains a contour adjustment.

10. The medical hair prosthesis according to claim 1, wherein said at least two wires are flesh tone, laminated contour wires.

11. The medical hair prosthesis according to claim 1, further comprising a skullcap composed of anti-bacterial cotton material placed between the scalp of said wearer and said medical hair prosthesis.

12. The medical hair prosthesis according to claim 11, wherein said skullcap has a front section that contains three 4½ by 1¾ inch rectangles cut out of said skullcap.

13. A medical hair prosthesis for a wearer comprising:

a base having a crown section, a front section contiguous to said crown section and a back section contiguous to said front section and said crown section, said front section including a hairline portion, said base composed of a lace, said lace having been treated by a cryogenic process to enhance the strength and durability of said base, said lace of said crown section being composed of 100% nylon, and said lace of said back section being composed of either about 84% nylon and about 16% spandex or 100% spandex;

a plurality of hairs attached to said base, said plurality of hairs including a portion that is the natural hair of the wearer and the remainder is synthetic fibers, wherein only the wearer's natural hair obtained by harvesting is attached to the hairline portion;

at least one coating applied to said base to secure said plurality of hairs in place;

at least one contour adjustment within said at least one coating; and a first set of at least two wires attached to said front section and a second set of at least two wires attached to said back section to provide ease of contouring said medical hair prosthesis to said wearer's scalp.

14. The medical hair prosthesis according to claim 13, wherein said lace of said front section is made of the same 100% nylon lace as said crown section or a thin 100% nylon lace.

15. The medical hair prosthesis according to claim 13, wherein said lace of said crown section contains a plurality of holes about 5 mm in diameter.

16. A medical hair prosthesis comprising:

a base having a crown section, a front section extending to the top of a wearer's head and contiguous to said crown section and a back section contiguous to said front section and said crown section, said base composed of a lace, said front section including a hairline portion, said lace having been treated by a cryogenic process to enhance the strength and durability of said base, said lace of said front section and said crown section composed of 100% nylon, and said lace of said back section composed of about 84% nylon and about 16% spandex or glass gauze;

a plurality of hairs attached to said base, said plurality of hairs including a portion that is the natural hair of said wearer and the remainder is synthetic fibers, wherein only the wearer's natural hair obtained by harvesting is attached to the hairline portion;

at least one coating applied to said base to secure said plurality of hairs in place, at least one contour adjustment within said at least one coating; and a first set of at least two wires attached to said front section and a second set of at least two wires attached to said back section to provide ease of contouring said medical hair prosthesis to said user's scalp.

17. The medical hair prosthesis according to claim 16, wherein said lace of said crown section contains a plurality of holes about 5 mm in diameter.

18. The medical hair prosthesis according to claim 16, wherein said at least one coating comprises a first coating applied to said front section continuous to said back section.

19. The medical hair prosthesis according to claim 16, wherein said first coating is one to three layers of either polyurethane or silicone.

20. The medical hair prosthesis according to claim 16, wherein said back section has a pair of side portions and a central portion, wherein said at least one coating comprises a first coating, and a second coating applied to the lower ends of said pair of side portions and said central portion.

21. The medical hair prosthesis according to claim 20, wherein said second coating is one to three layers of either polyurethane or silicone.

22. The medical hair prosthesis according to claim 16, wherein said at least one contour adjustment may be placed in said at least one coating.

23. The medical hair prosthesis according to claim 17, wherein said lace of said crown section composed of a glass gauze.

24. The medical hair prosthesis according to claim 23, wherein said glass gauze is composed of a transparent silk material.

25. The medical hair prosthesis according to claim 16, wherein said at least one coating has at least two contour adjustments.

26. A medical hair prosthesis for a wearer comprising:

a base having a crown section, a front section contiguous to said crown section and a back section contiguous to said front section and said crown section, said front section including a hairline portion, said base composed of a lace, said lace having been treated by a cryogenic process to enhance the strength and durability of said base; said lace of said crown section is composed of about 84% nylon and about 16% spandex, said lace of said front section is composed of 100% nylon, and said lace of said back section is composed of either about 84% nylon and about 16% spandex or 100% spandex, a plurality of hairs attached to said front section and said back section, said plurality of hairs including a portion that is the natural hair of the wearer and the remainder is synthetic fibers, wherein only the wearer's natural hair obtained by harvesting is attached to the hairline portion; and at least one coating applied to said base to secure said plurality of hairs in place, wherein said medical hair prosthesis is worn with a hat, cap, scarf or head wrap.

27. The medical hair prosthesis according to claim 26, wherein said plurality of hairs of said front section are attached at a 45 degree angle.

28. The medical hair prosthesis according to claim 26, wherein said plurality of hairs of said back section are attached horizontally.

29. The medical hair prosthesis according to claim 26, said crown section is left void of hair to allow the scalp of said wearer to breath and perspiration to evaporate easily.

30. A method of making a medical hair prosthesis comprising:

providing a base having a crown section, a front section contiguous to said crown section and a back section contiguous to said front and said crown section, said front section including a hairline portion, said base composed of a lace, said lace having been treated by a cryogenic process to enhance the strength and durability of said base;

attaching a plurality of hairs to said base, said plurality of hairs including a portion that has been obtained by a method of harvesting a wearer's own hair;

attaching only the wearer's own hair obtained by harvesting to the hairline portion;

applying synthetic fibers to a majority of the remainder of said base; and applying at least one coating to said base to secure said plurality of hairs in place.

31. The method of claim 30, wherein the hairline portion is thinner than the remainder of the front section.

* * * * *